US010916221B2

(12) United States Patent
Wu et al.

(10) Patent No.: US 10,916,221 B2
(45) Date of Patent: Feb. 9, 2021

(54) DISPLAY DEVICE

(71) Applicant: InnoLux Corporation, Miao-Li County (TW)

(72) Inventors: Yuan-Lin Wu, Miao-Li County (TW); Kuan-Feng Lee, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 29 days.

(21) Appl. No.: 15/826,639

(22) Filed: Nov. 29, 2017

(65) Prior Publication Data

US 2018/0322848 A1 Nov. 8, 2018

Related U.S. Application Data

(60) Provisional application No. 62/539,579, filed on Aug. 1, 2017, provisional application No. 62/527,198, filed on Jun. 30, 2017, provisional application No. 62/500,539, filed on May 3, 2017.

(51) Int. Cl.

| | |
|---|---|
| ***G09G 5/14*** | (2006.01) |
| ***G09G 3/20*** | (2006.01) |
| ***G09G 5/00*** | (2006.01) |
| ***G09G 3/36*** | (2006.01) |

(52) U.S. Cl.

CPC ..... *G09G 5/14* (2013.01); *G09G 3/2092* (2013.01); *G09G 3/3666* (2013.01); *G09G 5/00* (2013.01); *G09G 2310/0221* (2013.01); *G09G 2360/04* (2013.01); *G09G 2380/02* (2013.01)

(58) Field of Classification Search

CPC ..... G09G 3/2092; G09G 3/3666; G09G 5/00; G09G 5/14; G09G 2310/0221; G09G 2360/04; G09G 2380/02

See application file for complete search history.

(56) References Cited

U.S. PATENT DOCUMENTS

| | | | | |
|---|---|---|---|---|
| 2007/0182663 | A1* | 8/2007 | Biech | G06F 1/1618 345/1.1 |
| 2010/0277443 | A1* | 11/2010 | Yamazaki | G02F 1/1368 345/204 |
| 2012/0194773 | A1* | 8/2012 | Kim | G02F 1/13336 349/139 |
| 2014/0049449 | A1* | 2/2014 | Park | G09G 5/00 345/1.3 |
| 2014/0354143 | A1* | 12/2014 | Jung | H01L 51/0097 313/511 |
| 2015/0008396 | A1* | 1/2015 | Naijo | H01L 51/0097 257/40 |
| 2015/0220299 | A1* | 8/2015 | Kim | G06F 1/1635 345/1.3 |
| 2015/0255023 | A1* | 9/2015 | Lee | G06F 1/1681 345/204 |
| 2016/0007441 | A1* | 1/2016 | Matsueda | G06F 1/1652 361/749 |

(Continued)

*Primary Examiner* — Amare Mengistu
*Assistant Examiner* — Crystal Mathews
(74) *Attorney, Agent, or Firm* — Winston Hsu

(57) ABSTRACT

A display device includes a first display unit, a second display unit, and a connecting member for connecting the first display unit with the second display unit. The connecting member is foldable such that the display device may be folded at the connecting member. There is no signal transmission between the first display unit and the second display unit through the connecting member.

13 Claims, 20 Drawing Sheets

(56) References Cited

U.S. PATENT DOCUMENTS

| | | | | |
|---|---|---|---|---|
| 2016/0048171 | A1 | 2/2016 | Lee | |
| 2016/0109908 | A1* | 4/2016 | Siddiqui | G06F 1/1618 361/679.27 |
| 2016/0209877 | A1* | 7/2016 | Chong | G06F 1/1652 |
| 2017/0032737 | A1* | 2/2017 | Lee | G09G 3/3225 |
| 2019/0025620 | A1* | 1/2019 | Tuan | G02F 1/133305 |

* cited by examiner

DISPLAY DEVICE

BACKGROUND OF THE DISCLOSURE

1. Field of the Disclosure

The present disclosure relates to a display device, and more particularly, to a foldable display device.

2. Description of the Prior Art

In recent years, foldable electronic devices have become one of the focuses of the new generation electronic technology. The demand of the foldable display device that can be integrated in the foldable electronic device is therefore increased. A foldable display device means the device can be curved, folded, stretched, flexed, or the like (generally referred to as "foldable" hereinafter). However, some elements or films of the conventional display device may be damaged due to the folding or flexing state of the display device, such as the electrodes, the encapsulation layer, and the signal lines. Thus, the stability and the reliability of the foldable display device are seriously affected.

SUMMARY OF THE DISCLOSURE

The present disclosure provides a display device that includes a first display unit, a second display unit, and a connecting member for connecting the first display unit with the second display unit. The connecting member is foldable such that the display device is capable of being folded at the connecting member. There is no signal transmission between the first display unit and the second display unit through the connecting member.

The present disclosure further provides a foldable display device that includes a display panel having a first display region, a second display region, and a foldable region adjacent between the first display region and the second display region. The foldable region is capable of being repeatedly folded. There is no signal transmission between the first and second display regions through the foldable region.

The present disclosure even further provides a foldable display device that includes a display panel having a first display unit, a second display unit, and a first connecting member connecting the first display unit and the second display unit. The first connecting member is capable of being repeatedly folded. There is no signal transmission between the first display unit and the second display unit through the first connecting member.

These and other objectives of the present disclosure will no doubt become obvious to those of ordinary skill in the art after reading the following detailed description of the embodiment that is illustrated in the various figures and drawings.

DETAILED DESCRIPTION

The present disclosure may be understood by reference to the following detailed description, taken in conjunction with the drawings as described below. It is noted that, for purposes of illustrative clarity and being easily understood by the readers, various drawings of this disclosure show a portion of the display device, and certain elements in various drawings may not be drawn to scale. In addition, the number and dimension of each device shown in drawings are only illustrative and are not intended to limit the scope of the present disclosure.

Certain terms are used throughout the description and following claims to refer to particular components. As one skilled in the art will understand, electronic equipment manufacturers may refer to a component by different names. This document does not intend to distinguish between components that differ in name but not function. In the following description and in the claims, the terms "include", "comprise" and "have" are used in an open-ended fashion, and thus should be interpreted to mean "include, but not limited to . . . ".

It will be understood that when an element or layer is referred to as being "on" or "connected to" another element or layer, it can be directly on or directly connected to the other element or layer, or intervening elements or layers may be presented. In contrast, when an element is referred to as being "directly on" or "directly connected to" another element or layer, there are no intervening elements or layers presented.

It should be noted that the technical features in different embodiments described in the following can be replaced, recombined, or mixed with one another to constitute another embodiment without departing from the spirit of the present disclosure.

Figure 1:
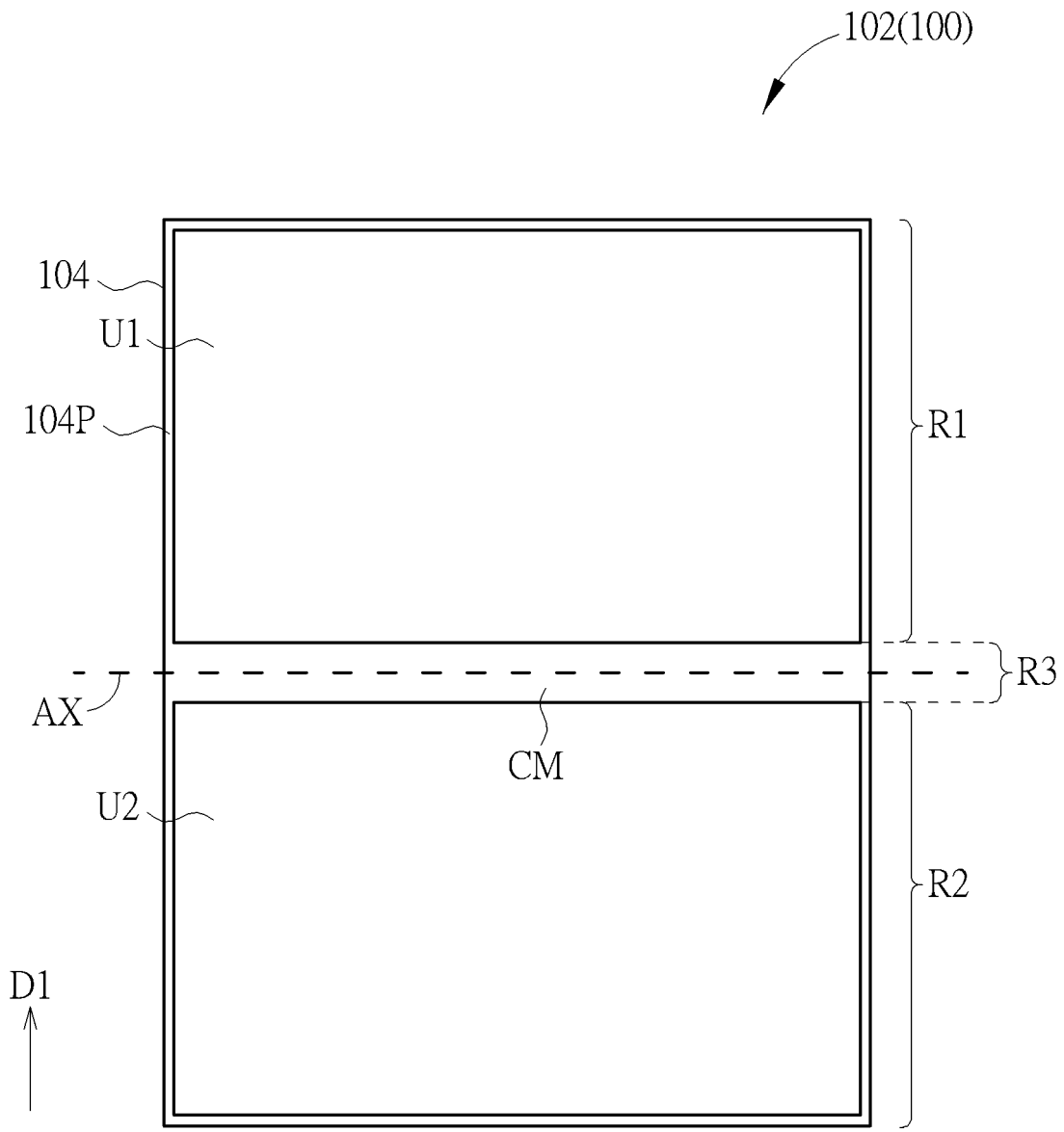
FIG. 1 is a top-view schematic diagram of a display device according to a first embodiment of the present disclosure.
Figure 2:
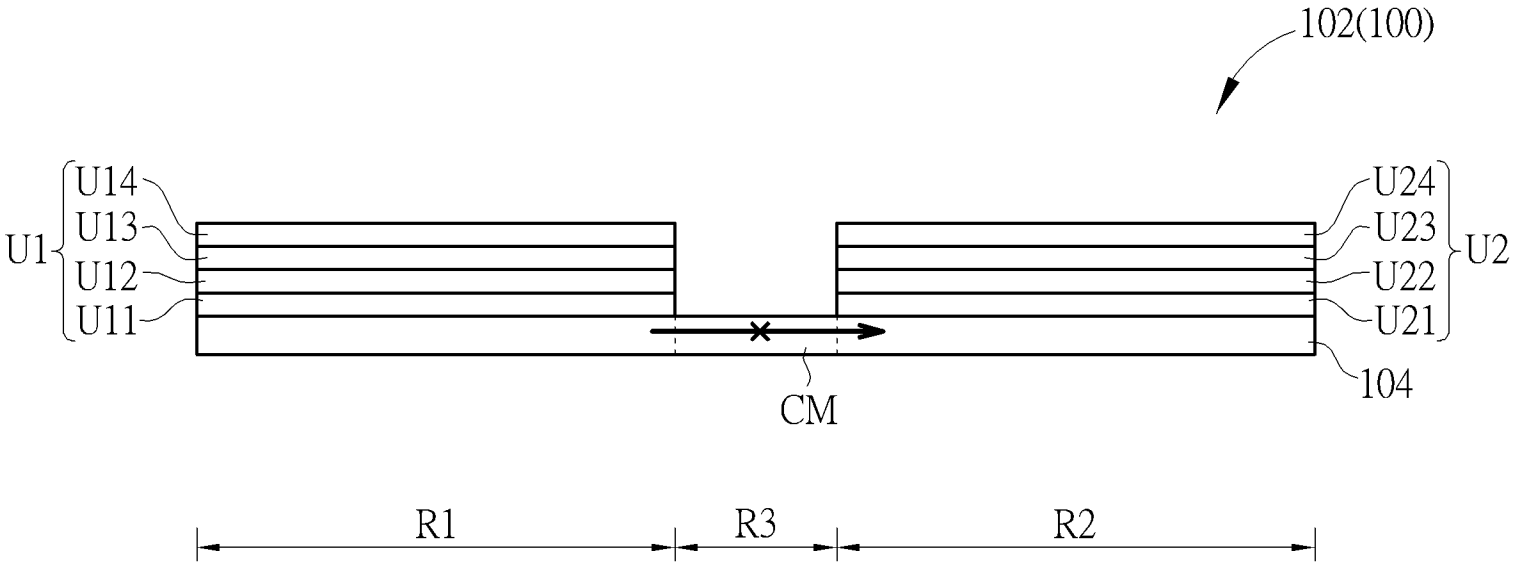
FIG. 2 is a sectional-view schematic diagram of the display device shown in FIG. 1.

Referring to FIG. 1 and FIG. 2, FIG. 1 is a top-view schematic diagram of a display device according to a first embodiment of the present disclosure, and FIG. 2 is a sectional-view schematic diagram of the display device shown in FIG. 1. A display device 100 of this embodiment shown in FIG. 1 and FIG. 2 is a foldable display device and includes a display panel 102, and the display panel 102 has a first display region R1, a second display region R2, and a foldable region R3. The foldable region R3 is disposed adjacent between the first display region R1 and the second display region R2 in a first direction D1. The foldable region R3 is capable of being repeatedly folded, which means the foldable region R3 may be curved, bended, folded, stretched and/or flexed along at least one folding axis AX. In this embodiment, the folding axis AX passes through the foldable region R3 and is perpendicular to the first direction D1.

The display panel 102 includes a first display unit U1, a second display unit U2, and a connecting member CM for connecting the first display unit U1 with the second display unit U2. As shown in FIG. 1, the connecting member CM is disposed between the first display unit U1 and the second display unit U2, and is disposed in the foldable region R3, thus the display device 100 may be foldable repeatedly at the connecting member CM. In detail, the display panel 102 includes a substrate 104, the first display unit U1 and the second display unit U2 are disposed on the substrate 104, and the substrate 104 has a peripheral region 104P defined thereon, wherein the peripheral region 104P surrounds the first display unit U1 and the second display unit U2. In this embodiment, the display device 100 is a narrow-border display device, thus the peripheral-edges of the first display unit U1 and the second display unit U2 is very close to the peripheral-edge of the substrate 104, which means the peripheral region 104P has narrow width.

The substrate 104 may include any material that is flexible. For example, the substrate 104 may include polymer material. In other words, the substrate 104 itself may be a polymeric substrate or a polymer layer, or the substrate 104 may include a polymer layer. As an example, the substrate 104 is a polyethylene terephthalate (PET) substrate, a polyimide (PI) substrate, or a polyethylene naphthalate (PEN) substrate, but not limited thereto. In some embodiments, the substrate 104 may be a thin glass substrate with a thickness of about 70-100 micrometers, but not limited thereto. In another aspect, the substrate 104 may include a flexible substrate, a supporting film and a supporting film glue for binding the flexible substrate and the supporting film. In this embodiment, the connecting member CM is a portion of the substrate 104 for connecting the first display unit U1 and the second display unit U2. According to some embodiments, there is no signal transmission between the first display unit U1 and the second display unit U2 through the connecting member CM, which means there are no signal lines, traces, or wires disposed in the foldable region R3. Accordingly, the related elements for signal transmission will not be easily damaged due to the folding of the display device 100. Furthermore, since there is no important electronic device or wire disposed in the foldable region R3, the design and selection of the structure and material of the foldable region R3 is more flexible and easily. For example, the foldable region R3 may be very narrow such that the first display unit U1 and the second display unit U2 can be very close such that they both appear as narrow-border display units or they are almost connect to each other.

In addition, in some embodiments, an integrated circuit (IC) chip or switching circuit device (not shown) may be disposed on the substrate 104 for delivering signals to the first display unit U1 and the second display unit U2. The IC chip or switching circuit device may be electrically connected to the elements in the first display unit U1 and the second display U2, in order to process different kinds of data for different purposes. Furthermore, the IC may include contacts or pins that are electrically connected to a printed circuit board (PCB) or the like (not shown). In some of the embodiments, the IC chip or switching circuit device may be disposed at the same side of the substrate 104 as the first display unit U1 and the second display unit U2, such as being disposed in the peripheral region 104P. In some other embodiments, the IC chip or switching circuit device may be disposed on the opposite side of the substrate 104 to the first display unit U1 and the second display unit U2.

Referring to FIG. 2, the display device 100 of this embodiment can be a touch display device, and therefore each of the first display unit U1 and the second display unit U2 can be a touch display unit, but not limited thereto. In detail, the first display unit U1 of this embodiment includes an circuit layer U11, a display layer U12, a touch layer U13, and a cover layer U14 disposed on the substrate 104 from bottom to top sequentially, but not limited thereto. The circuit layer U11 may include (but not limited to) data lines, gate lines, thin film transistors (TFTs), capacitors, and other electric elements for transmitting display signals. The display layer U12 is electrically connected to the circuit layer U11 and may include display cell (s), such as liquid crystal layer, organic light-emitting diodes (OLEDs), quantum light-emitting diodes (QLEDs), micro-LEDs, or mini-LEDs. The touch layer U13 includes touch sensing elements, and may be or not be electrically connected to the circuit layer U11. The cover layer U14 covers the touch layer U13 to provide protection to the touch layer U13 and the electronic device therebelow. The cover layer U14 may include glass or polymeric materials as an example. Similarly, the second display unit U2 of this embodiment includes, but not limited to, an circuit layer U21, a display layer U22, a touch layer U23, and a cover layer U24 disposed on the substrate 104 from bottom to top sequentially, these layers may have similar structures and materials to those in the first display unit U1, but not limited thereto. In a variant embodiment of this embodiment, the first display unit U1 and/or the second display unit U2 may not include the touch layer U13, the cover layer U14, the touch layer U23, and the cover layer U24. As mentioned above, there is no electronic element disposed in the foldable region R3, such that there is no signal transmission between the first display region R1 and the second display region R2, as presented by the arrow with the cross in FIG. 2.

In FIG. 2, the connecting member CM is illustrated in the form of the substrate 104. In other embodiments, the connecting member CM can be other layer included by the display units. For example, the connecting member can be the same layer as a cover layer U14. For example, the connecting member CM can be the same layer as a polarizer layer (not shown) included in the display layer U12. For example, the connecting member CM can be the same layer as an encapsulation layer (not shown) included in the display layer U12. In other embodiments, the connecting member CM can be a polymer layer (not shown) included in the display layer U12.

Figure 3:
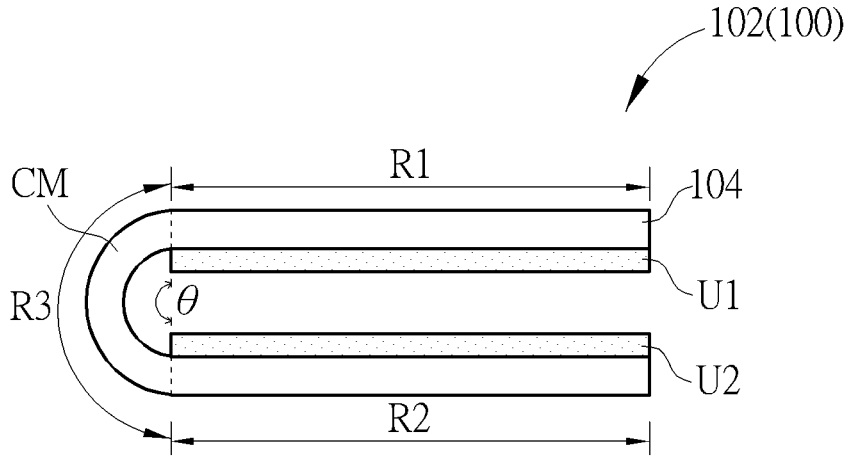
FIG. 3 is a sectional-view schematic diagram illustrating the display device shown in FIG. 2 being folded inwardly.
Figure 4:
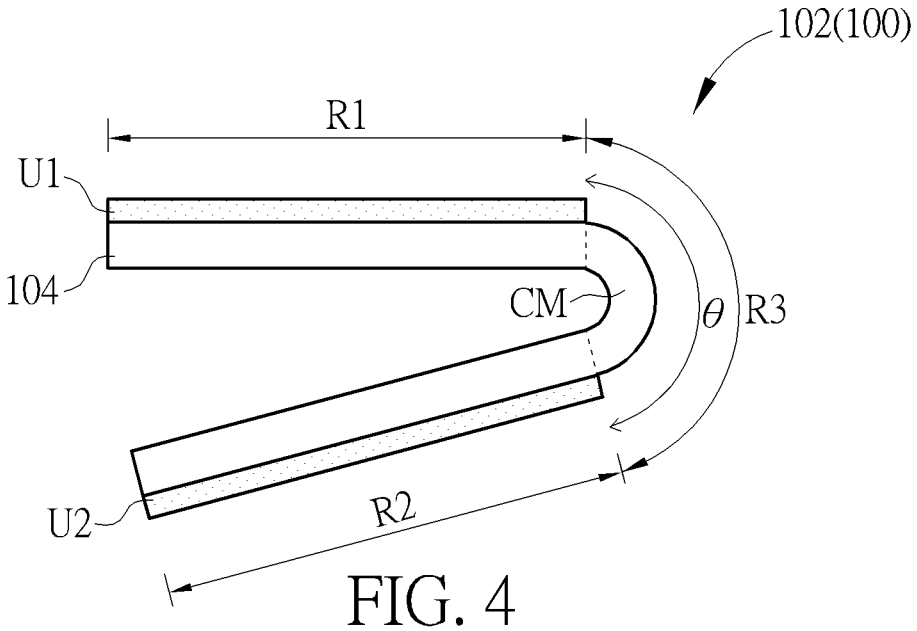
FIG. 4 is a sectional-view schematic diagram illustrating the display device shown in FIG. 2 being folded outwardly.

Referring to FIG. 3 and FIG. 4, FIG. 3 is a sectional-view schematic diagram illustrating the display device shown in FIG. 2 being folded inwardly, and FIG. 4 is a sectional-view schematic diagram illustrating the display device shown in FIG. 2 being folded outwardly, wherein only a layer is illustrated for respectively representing the first display unit U1 and the second display unit U2. As shown in FIG. 3, the display device 100 is folded inwardly, and the first display unit U1 and the second display unit U2 are positioned between the folded substrate 104 when the display device 100 is folded. The folding angle θ is 180 degrees for example in FIG. 3. According to some embodiments, the folding angle θ may range from 0 degree to 180 degrees when the display device 100 is folded inwardly, but not limited thereto. As shown in FIG. 4, the display device 100 is folded outwardly, and the folded substrate 104 is positioned between the first display unit U1 and the second display unit U2 when the display device 100 is folded. The folding angle θ is −150 degrees for example in FIG. 4. According to some embodiments, the folding angle θ may range from 0 degree to −180 degrees when the display device 100 is folded outwardly, but not limited thereto.

Figure 5:
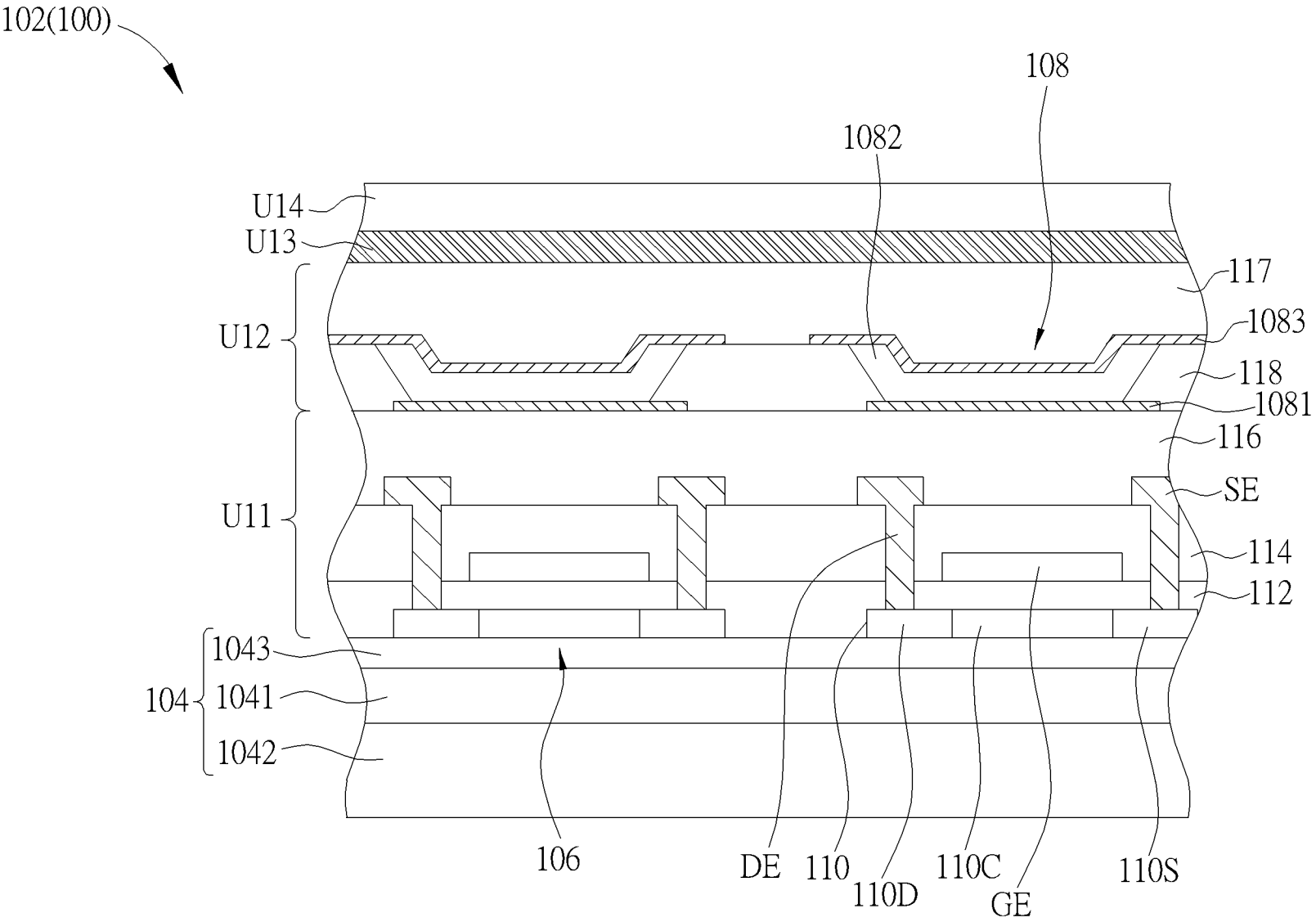
FIG. 5 is a partial enlargement of a sectional schematic diagram of the first display unit shown in FIG. 2.

Referring to FIG. 5, FIG. 5 is a partial enlargement of a sectional schematic diagram of the first display unit U1 shown in FIG. 2. For example, the first display unit U1 is an OLED unit. The above-mentioned substrate 104 may selectively include a flexible substrate 1041 disposed on a supporting film 1042, and a buffer layer 1043 may be disposed between the flexible substrate 1041 and the circuit layer U11. In this embodiment, the supporting film 1042 may include PET or the like, and the buffer layer 1043 may include an oxide layer, a nitride layer, a combination thereof, or other suitable insulating layer, but not limited thereto.

The circuit layer U11 includes a semiconductor layer 110, a gate dielectric layer 112, a conductive layer having gate electrodes GE, a dielectric layer 114, a conductive layer having drain electrodes DE and source electrodes SE, and an optional dielectric layer 116, so as to form a plurality of thin film transistors (TFTs) 106, which serve as switch elements for driving the display elements 108 in the display layer U12. The semiconductor layer 110 is formed of a semiconductor material, such as silicon or metal oxide, but not limited thereto. For example, the semiconductor layer 110 may be amorphous silicon, polysilicon, or indium gallium zinc oxide (IGZO). The semiconductor layer 110 includes a source contact 110S, a drain contact 110D, and a channel 110C disposed between the source contact 110S and the drain contact 110D in one TFT 106. Each source electrode SE is electrically connected to the corresponding source contact 110S through a via hole in the dielectric layer 114 and the gate dielectric layer 112. Each drain electrode DE is electrically connected to the corresponding drain contact 110D through another via hole in the dielectric layer 114 and the gate dielectric layer 112. The gate electrode GE is separated from the channel 110C by the gate dielectric layer 112. The gate electrode GE, the source electrode SE, and the drain electrode 132 may be formed of conductive materials (such as metal), but not limited thereto. It should be noted that the structure of the TFTs 106 shown in FIG. 5 is merely an example and is not meant to limit the types or structures of the TFTs 106 of the present disclosure, and any other suitable TFT structures may replace the illustrated TFTs 106. For example, the TFTs 106 are top-gate type TFTs in this embodiment; however, bottom-gate type TFTs may be used as the TFTs 106 in a variant embodiment.

The display layer U12 includes a plurality of display elements 108 and a pixel defining layer 118. In this embodiment, the display elements 108 are organic light-emitting diodes (OLED) as an example, but not limited thereto. In other embodiments, the display elements 108 may be any other suitable types of display elements or have other structures, such as micro LEDs or mini LEDs. The display elements 108 may include quantum dot (QD) materials or phosphor materials. The display elements 108 may be defined by the openings of the pixel defining layer 118. Each display element 108 shown in FIG. 5 is formed of a first electrode 1081, an organic layer 1082, and a second electrode 1083, and the display areas of the display elements 108 are separated from each other by the pixel defining layer 118. The first electrode 1081 of each display element 108 may be electrically connected to a corresponding TFT 106 respectively through a conductive electrode (not shown). In one embodiment, the first electrode 1081 and the conductive electrode may share a same layer. In each of the display elements 108, the first electrode 1081 may be an anode and the second electrode 1083 may be a cathode of the display element 108, and vice versa. The organic layer 1082 includes one or more layers of organic emissive material. The first electrode 1081 and the second electrode 1082 may include metal or transparent conductive material respectively. Examples of the metal material of the electrodes include Mg, Ca, Al, Ag, W, Cu, Ni, Cr, or an alloy thereof. Examples of the transparent conductive material include indium tin oxide (ITO), indium zinc oxide (IZO), zinc oxide, or indium oxide. In this embodiment, the first electrodes 1081 are made of metal material, and the second electrodes 1083 are made of transparent conductive material, but not limited thereto. In other embodiments, the first electrodes 1081 are made of transparent conductive material, and the second electrodes 1083 are made of metal. In addition, the display layer U12 may further include an insulating layer 117 disposed on the display elements 108. The insulating layer 117 may be, but not limited to, an encapsulation layer or a planarization layer, and may include one or multiple layers. For example, the insulating layer 117 may include a first inorganic layer, an organic layer, and a second inorganic layer stacked from bottom to top, wherein the material of the first inorganic layer and the second inorganic layer may independently include silicon nitride or oxide material, but not limited thereto.

Furthermore, in this embodiment, the touch layer U13 is disposed on the display layer U12. Although FIG. 5 shows that the touch layer U13 directly contact the display layer U12, the touch layer U13 may be indirectly disposed on the display layer U12 in some other embodiments, which means an adhesive layer or other layer(s) may be disposed between the touch layer U13 and the display layer U12. The cover layer U14 covers the touch layer U13 for providing protection to the touch layer U13. The cover layer U14 may include organic material or glass material, but not limited thereto.

As shown in FIG. 5, the touch layer U13 is disposed between the cover layer U14 and the display layer U12, thus constructing an out-cell touch type or on-cell touch type display device. The position of the touch layer U13 can be changed according to designs. According to some embodiments, the touch layer U13 can be disposed in the display layer U12. For example, the touch layer U13 can be made of the same layer as an electrode in the display layer U12. Thus, an in-cell touch type display device can be constructed. The touch layer U13 can include more than one layer. According to other embodiments, the touch layer U13 can include two layers. One touch layer can be in the display layer U12, and the other touch layer can be disposed on the display layer U12, for example, on the encapsulation layer. Thus, a hybrid touch type display device can be constructed.

The structure of the second display unit U2 may be similar to the first display unit U1 shown in FIG. 5, thus the structure of the second display unit U2 will not be redundantly described in detail.

The display device of the present disclosure is not limited to the above embodiment and variant embodiments. Further embodiments or variant embodiments of the present disclosure are described below. To compare the embodiments or the variant embodiments conveniently and simplify the description, the same component would be labeled with the same symbol in the following. The following description will detail the dissimilarities among different embodiments and variant embodiments and the identical features will not be redundantly described.

Figure 6A:
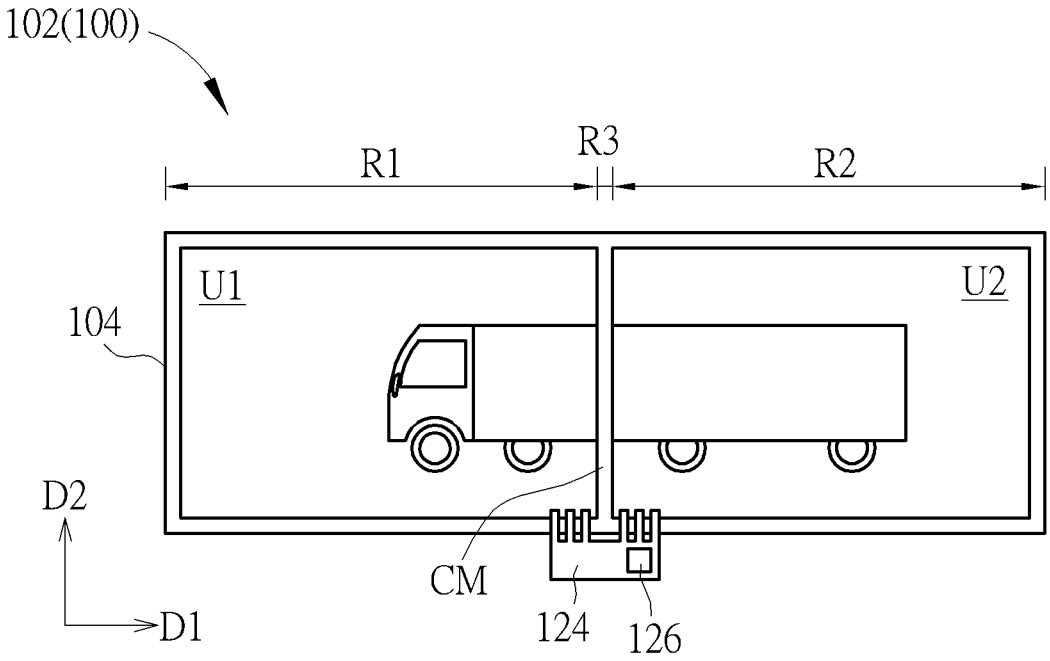
FIG. 6A is a top-view schematic diagram of a display device which is operated under a first operation state according to a second embodiment of the present disclosure.
Figure 7:
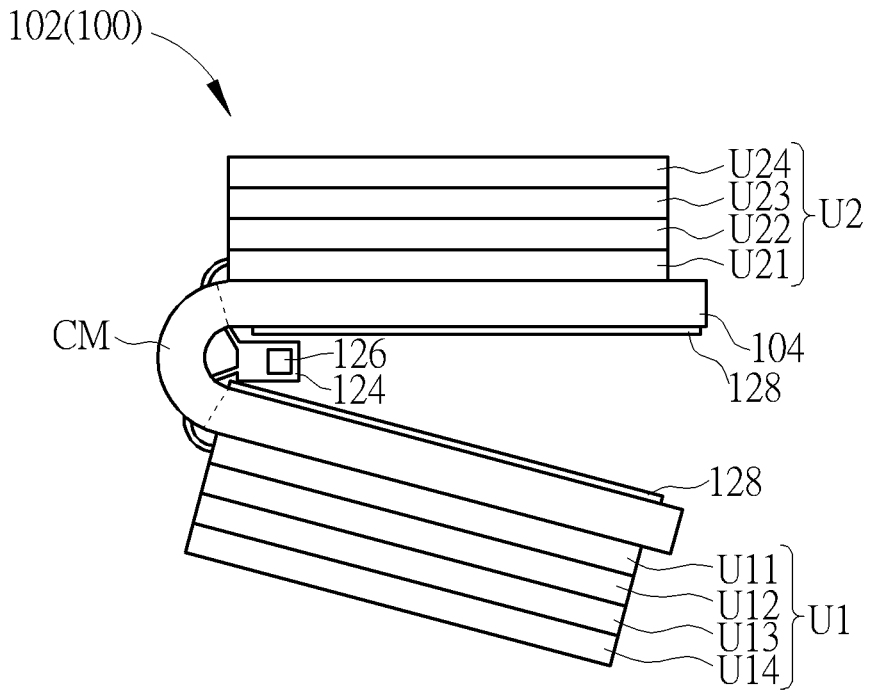
FIG. 7 is a sectional-view schematic diagram of the display device according to the second embodiment of the present disclosure.

Referring to FIG. 6A and FIG. 7, FIG. 6A is a top-view schematic diagram of a display device according to a second embodiment of the present disclosure, and FIG. 7 is a sectional-view schematic diagram of the display device according to the second embodiment of the present disclosure, wherein FIG. 7 illustrates the folding state of the display device. The folding axis of the display device 100 of this embodiment is parallel to a second direction D2. This embodiment is different from the first embodiment mainly in that the display device 100 shown in FIG. 6A and FIG. 7 further includes a circuit board 124 that connects both the first display unit U1 in the first display region R1 and the second display unit U2 in the second display region R2 at its two ends. The circuit board 124 may be a printed circuit board (PCB) or a chip-on-film (COF) packaged board. For example, one or more integrated circuit (IC) chip(s) 126 may be disposed on the circuit board 124. In this embodiment, the IC chip 126 can include a timing controller or a control unit for controlling the display image of the first display unit U1 and the second display unit U2 at the same time. Similar to the first embodiment, there is no signal transmission between the first display unit U1 and the second display unit U2 through the connection member CM in the foldable region R3. In other embodiments and variant embodiment described hereinafter, the display devices of the present disclosure have the common feature that no signal transmission exist between adjacent display units or display regions for mitigate the damage to the electronic elements.

Figure 6B:
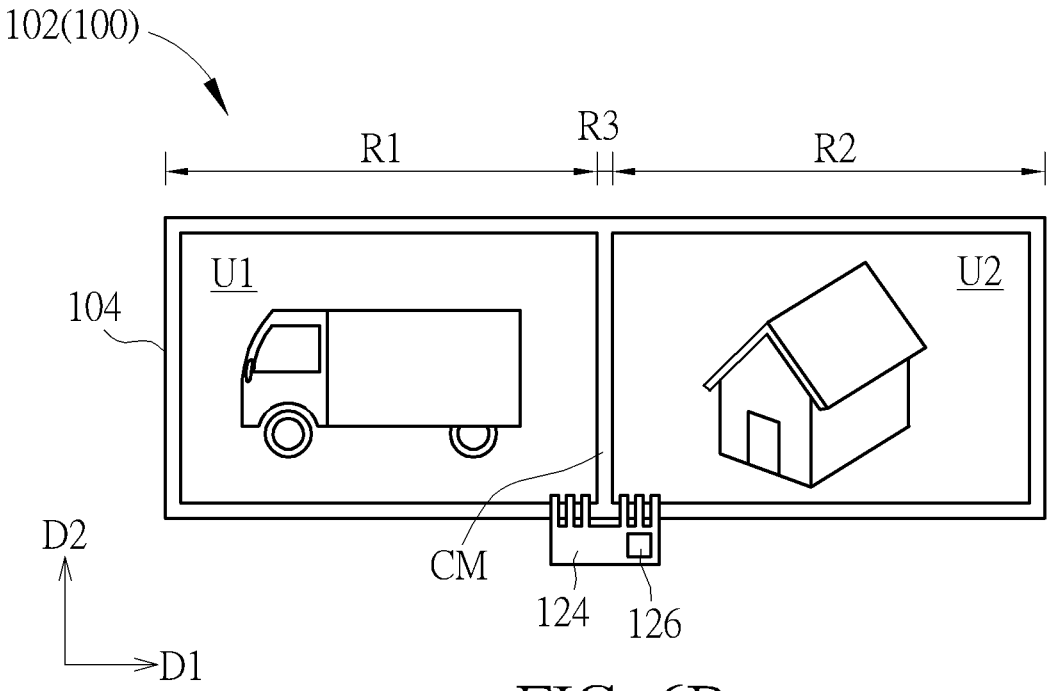
FIG. 6B is a top-view schematic diagram of a display device which is operated under a second operation state according to a second embodiment of the present disclosure.

FIGS. 6A and 6B respectively show different operation states. As shown in FIG. 6A, when the display device 100 is operated under a first operation state, the first display unit U1 and the second display unit U2 display a continuous image together, which means the image displayed by the first display unit U1 and the image displayed by the second display unit U2 form a complete display image. As shown in FIG. 6B, when the display device 100 is operated under a second operation state, the first display unit U1 and the second display unit U2 independently display different images, which means the displayed images of the first display unit U1 and the second display unit U2 may be independent and in-continuous. The operation states of the display device 100 can be controlled by the timing controller in the IC chip 126. In addition, as shown in FIG. 7, the display device 100 can further include a bending sensor 128 disposed on a side of the substrate 104 opposite to the first display unit U1 and the second display unit U2. The bending sensor 128 is used for detecting whether the display device 100 is folded or not. For example, when the bending sensor 128 detects that the display device 100 is folded, it may transmit a signal to the IC chip 126 to control the first display unit U1 and the second display unit U2 to display independent images. When the bending sensor 128 detects that the display device 100 is not folded, it may transmit a signal to the IC chip 126 to control the first display unit U1 and the second display unit U2 to display continuous images. In some examples, the first operation and the second operation state may be determined by the folding angle (or bending angle) of the display device 100. In other words, the operation states can be determined according to the sensed folding angle by the bending sensor 128. The bending sensor 128 may be an optical sensor, such as infrared-ray (IR) sensor, that include a light emitter and a light receiver so as to determine the distance between the two ends of the bended substrate 104 or the bending angle, but not limited thereto.

Figure 8:
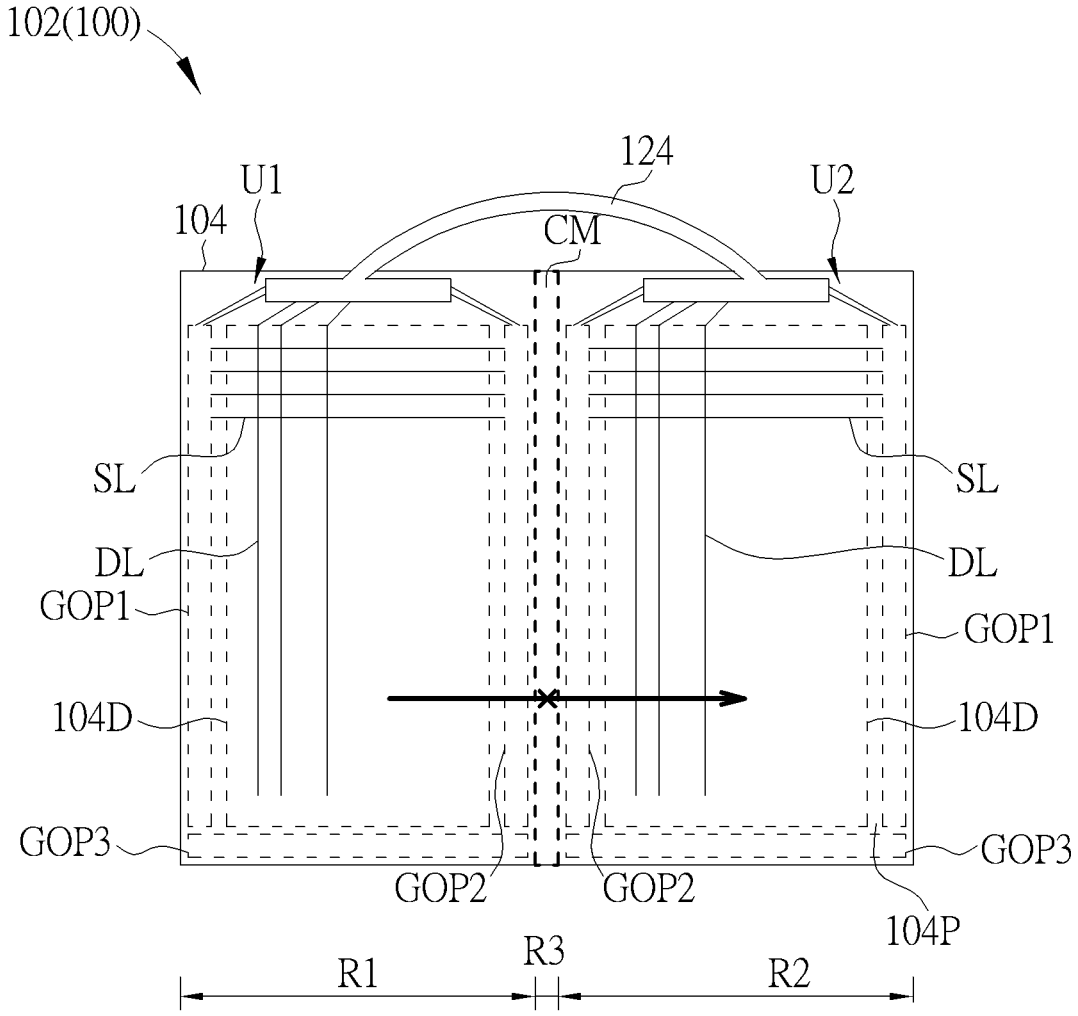
FIG. 8 is a top-view schematic diagram of a display device according to a third embodiment of the present disclosure.

Referring to FIG. 8, FIG. 8 is a top-view schematic diagram of a display device according to a third embodiment of the present disclosure. The display device 100 in this embodiment is different from the second embodiment in the arrangement and disposition design of the driver element or IC chip. In the first display region R1, the substrate 104 has at least one display region 104D surrounded by the peripheral region 104P, and the first display unit U1 includes a plurality of scan lines SL and a plurality of data lines DL that are arranged in the display region 104D. In this embodiment, the data lines DL are extended to the top of the peripheral region 104P to the circuit board 124 so as to be electrically connected to a COF chip (not shown). The control unit (not shown) included in the circuit board 124 is electrically connected to the first display unit U1 and the second display unit U2.

The scan lines SL extend to the gate driver regions GOP1 and GOP2 at the left side and the right side out of the display region 104D. In the gate driver regions GOP1 and GOP2, the circuits with gate-driver-on-panel (GOP) type are disposed, for providing driving signals to the scan lines SL, but not limited thereto. The second display unit U2 may have the similar structure and arrangement of the electronic devices, which will not be described redundantly. Similar to the first embodiment, there is no signal transmission between the first display unit U1 and the second display unit U2 through the connection member CM in the foldable region R3, as presented by the arrow with the cross. In other words, there are no other electronic elements, traces, or wires disposed in the foldable region R3 on the substrate 104.

According to some embodiments, the gate driver regions GOP2 shown in FIG. 8 can be removed, thus all the gate driver are disposed in the gate driver regions GOP1 at the left side and the right side of the substrate 104. Accordingly, the display regions 104D of both the first display unit U1 and the second display unit U2 can be enlarged toward the foldable region R3, but not extend to the foldable region R3, which means the border between the first display unit U1 and the second display unit U2 in this embodiment may be smaller than the third embodiment.

According to some embodiments, the gate driver regions GOP1 and GOP2 shown in FIG. 8 can be removed, and the gate driver can be disposed at the bottom side of the substrate 104, marked as GOP3 in FIG. 8. Thus, no GOPs are positioned at the left side and right side of the substrate. Therefore, the left border and the right border of the display device 100 can be further narrowed.

Figure 9:
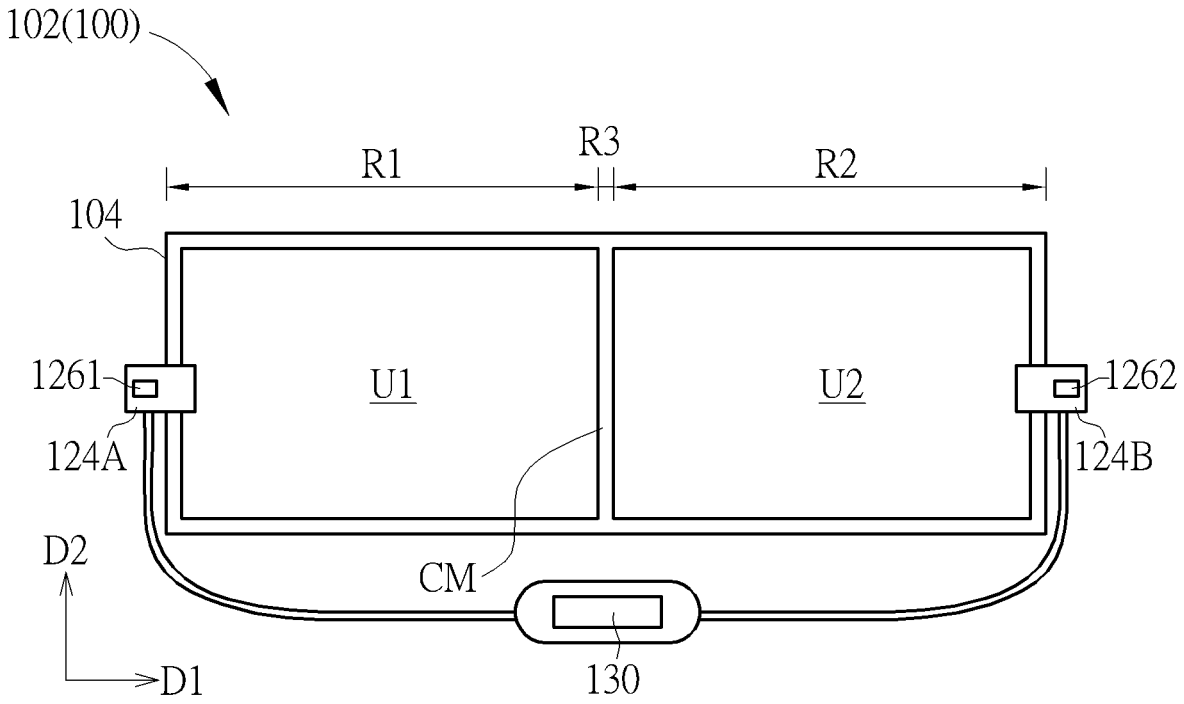
FIG. 9 is a top-view schematic diagram of a display device according to a fourth embodiment of the present disclosure.
Figure 10:
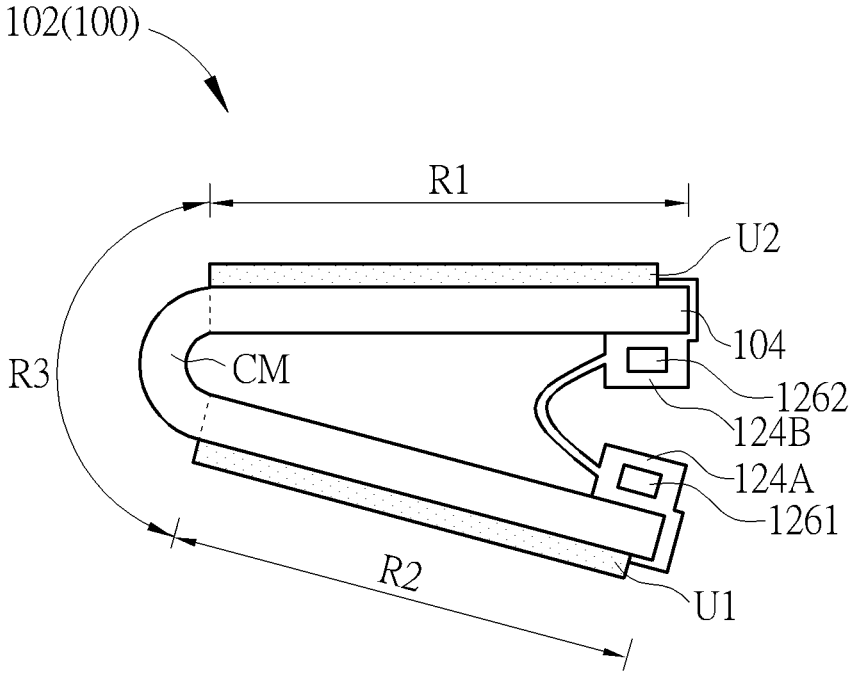
FIG. 10 is a sectional-view schematic diagram illustrating the display device shown in FIG. 9 being folded outwardly.

Referring to FIG. 9 and FIG. 10, FIG. 9 is a top-view schematic diagram of a display device according to a fourth embodiment of the present disclosure, and FIG. 10 is a sectional-view schematic diagram illustrating the display device shown in FIG. 9 being folded outwardly. This embodiment is mainly different from the second embodiment in that a control unit is respectively disposed at the left side and the right side of the display device 100.

As shown in FIG. 9, two circuit boards 124A and 124B are disposed. The IC chips 1261 and 1262 disposed on the circuit boards 124A and 124B respectively are illustrated for representing the control units (such as timing controllers), but not limited thereto. The circuit boards 124A and 124B may have PCB-type or COF type circuit boards. The IC chip 1261 with the control unit is used for controlling the display function of the first display unit U1, and the IC chip 1262 with the control unit is used for controlling the display function of the second display unit U2. Accordingly, the first display unit U1 and the second display unit U2 are independently controlled by different control units (such as timing controllers), and they cannot only display continuous images but also display independent images. In addition, a main controller 130 may be disposed on the circuit board 124 for controlling the independent timing controller in the IC chip 1261 and the IC chip 1262. According to the present disclosure, there is no signal transmission passes through the foldable region R3.

Figure 11:
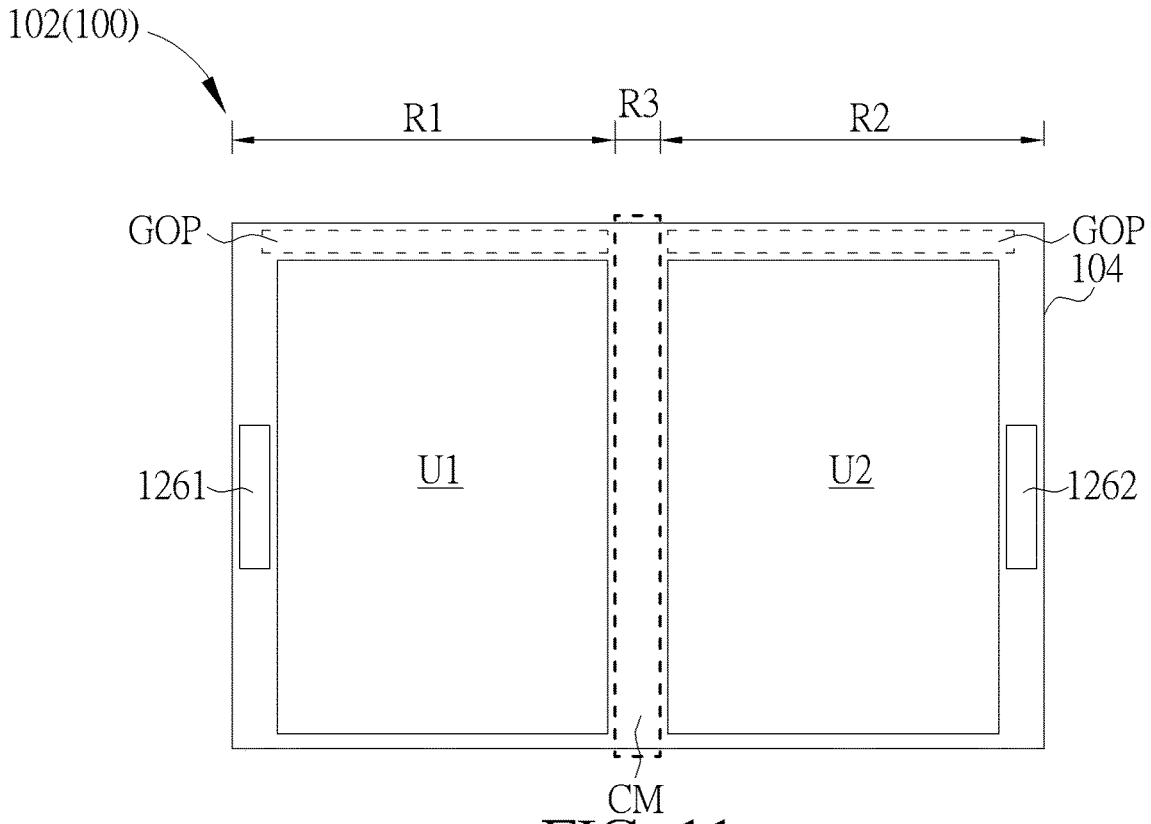
FIG. 11 is a top-view schematic diagram of a display device according to a fifth embodiment of the present disclosure.
Figure 12:
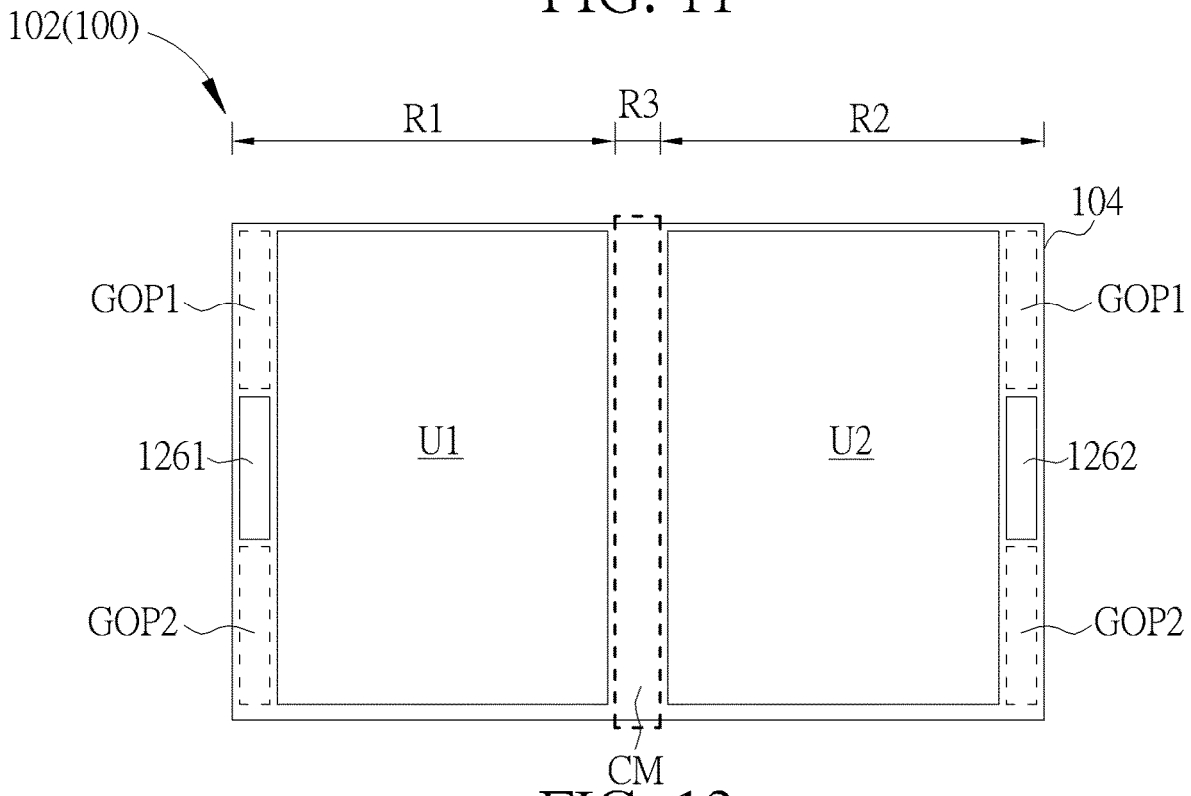
FIG. 12 is a top-view schematic diagram of a display device according to a sixth embodiment of the present disclosure.
Figure 13:
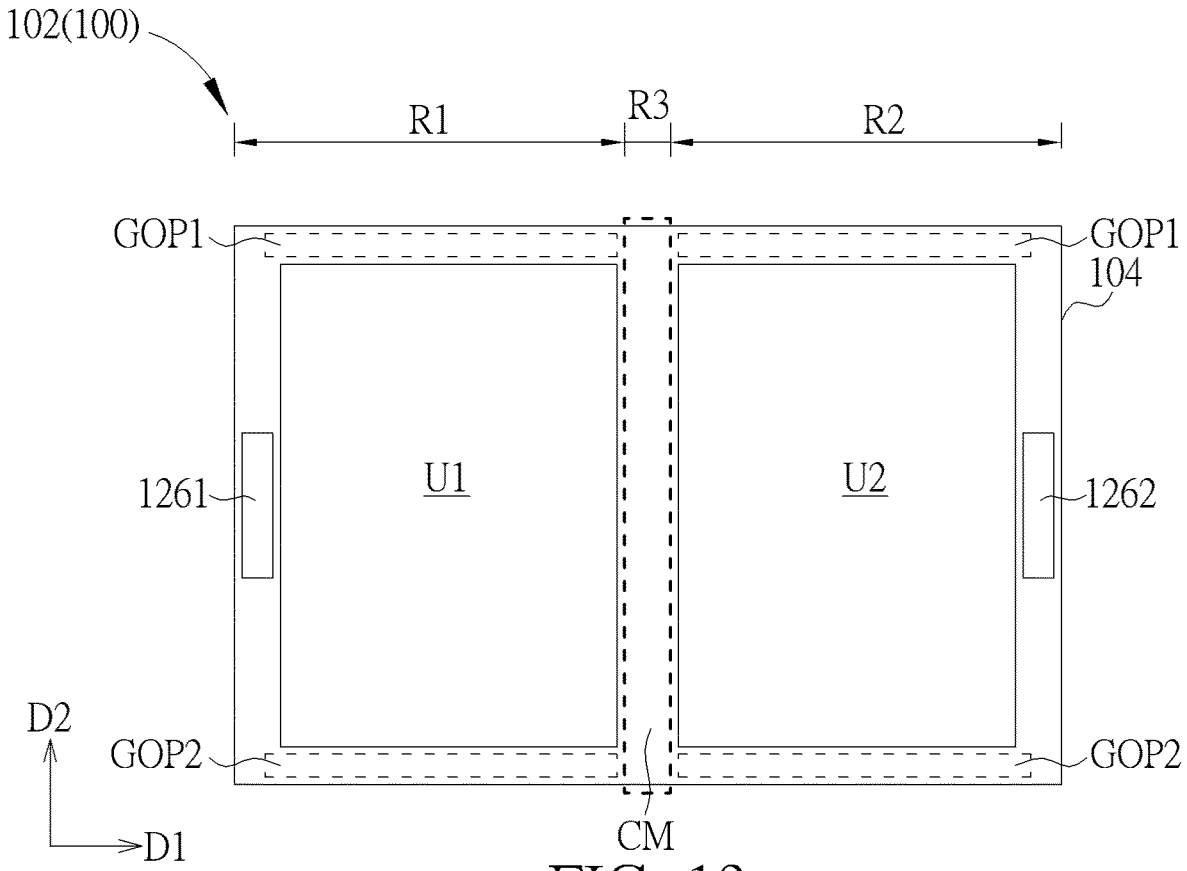
FIG. 13 is a top-view schematic diagram of a display device according to a seventh embodiment of the present disclosure.
Figure 14:
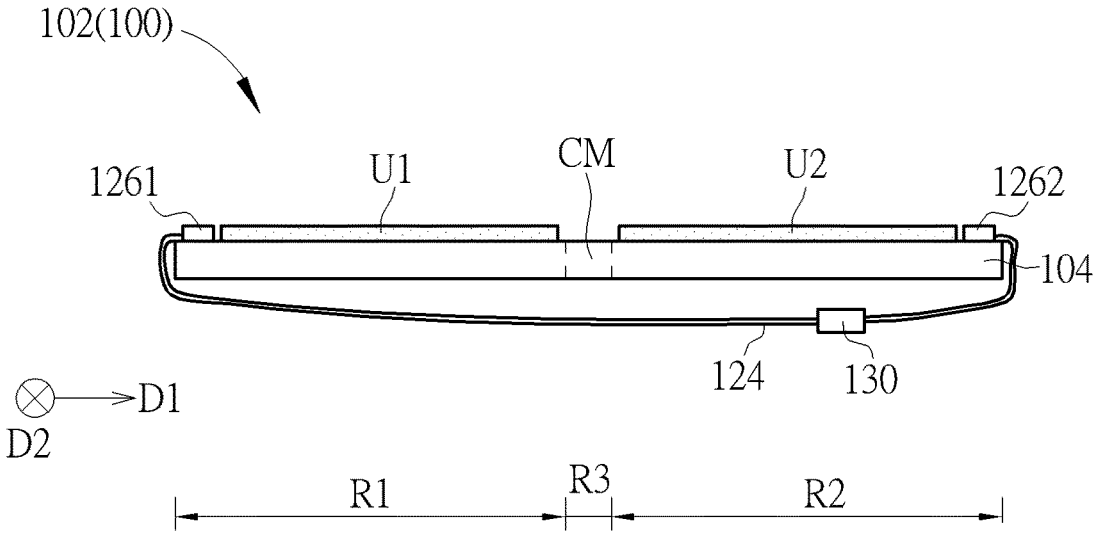
FIG. 14 is a sectional-view schematic diagram of the display device shown in FIG. 13.

Referring to FIG. 11 to FIG. 14, FIG. 11 is a top-view schematic diagram of a display device according to a fifth embodiment of the present disclosure, FIG. 12 is a top-view schematic diagram of a display device according to a sixth embodiment of the present disclosure, FIG. 13 is a top-view schematic diagram of a display device according to a seventh embodiment of the present disclosure, and FIG. 14 is a sectional-view schematic diagram of the display device shown in FIG. 13 along the first direction D1. These embodiments further introduce the different arrangement of the gate driver regions and the IC chips of the display units.

In the fifth embodiment shown in FIG. 11, the gate driver regions GOP of the first display unit U1 and the second display unit U2 are disposed at the upper side of the substrate 104, and the IC chip 1261 and the IC chip 1262 are respectively disposed at the left side and the right side of the substrate 104. The IC chips 1261 and 1262 may have a COF-type disposed on a PCB, but not limited thereto. The IC chips 1261 and 1262 may have a chip-on-array (COA) type in a variant embodiment. In the sixth embodiment shown in FIG. 12, the gate driver regions are divided into two regions, the gate driver regions GOP1 and GOP2, for each of the first display unit U1 and the second display unit U2, and the IC chip 1261 and the IC chip 1262 are respectively disposed between the gate driver regions GOP1 and GOP2. In the seventh embodiment shown in FIG. 13 and FIG. 14, the gate driver regions GOP1 and GOP2 are respectively disposed at the upper side and the lower side of the substrate 104, and a main controller 130 with COF-type package is disposed on the circuit board 124.

Figure 15:
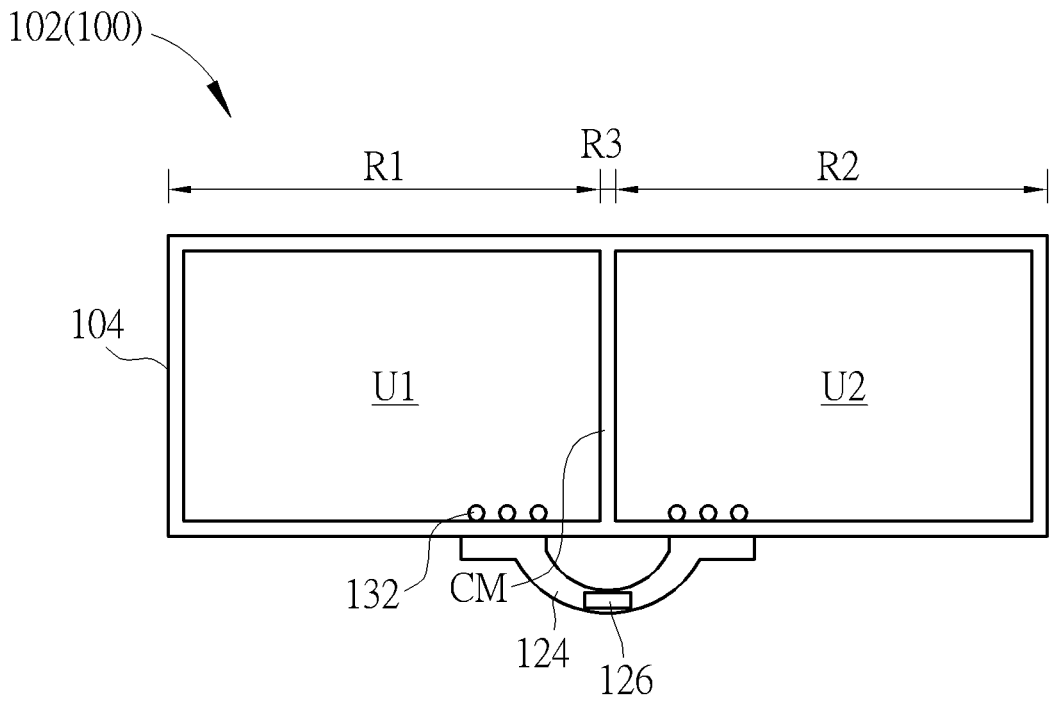
FIG. 15 is a top-view schematic diagram of a display device according to an eighth embodiment of the present disclosure.
Figure 16:
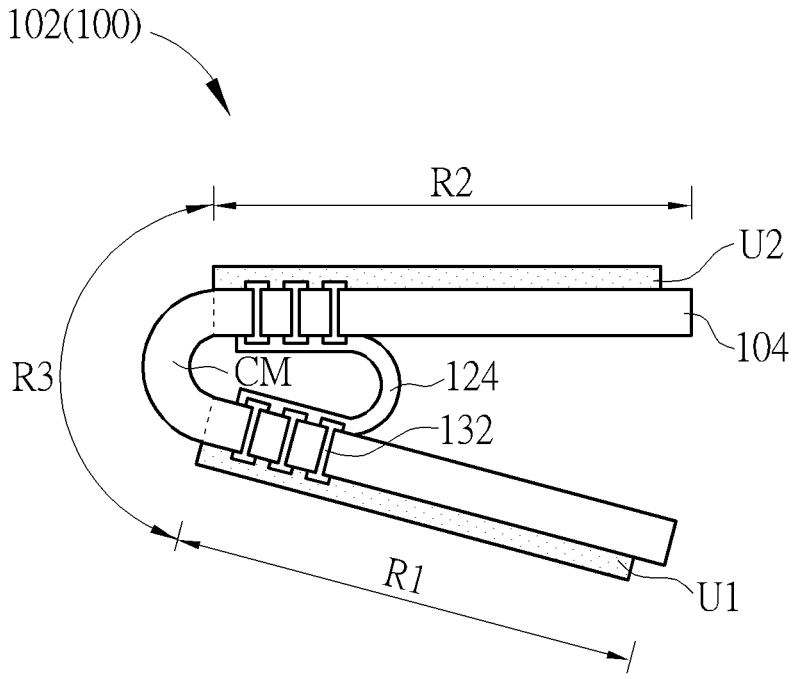
FIG. 16 is a sectional-view schematic diagram of the display device shown in FIG. 15.

Referring to FIG. 15 and FIG. 16, FIG. 15 is a top-view schematic diagram of a display device according to an eighth embodiment of the present disclosure, and FIG. 16 is a sectional-view schematic diagram of the display device shown in FIG. 15. Compared with the second embodiment shown in FIG. 6A, the circuit board 124 is connected to the substrate 104 at a backside of the substrate 104 in this embodiment. Specifically, the two ends of the circuit board 124 are attached on the substrate 104 at the side (backside) of the substrate 104 opposite to the first display unit U1 and the second display unit U2. The display panel 102 further includes one or a plurality of through holes 132 pass through the substrate 104, and the IC chip 126 on the circuit board 124 provides control signal to the first display unit U1 and the second display unit U2 through the through holes 132. In other words, the display device 100 in this embodiment adopts a through-glass-via (TGV) technology for electrically connecting the display units with the timing controller on the circuit board. Based on the technology, the borders of the display units can be further narrowed.

Figure 17:
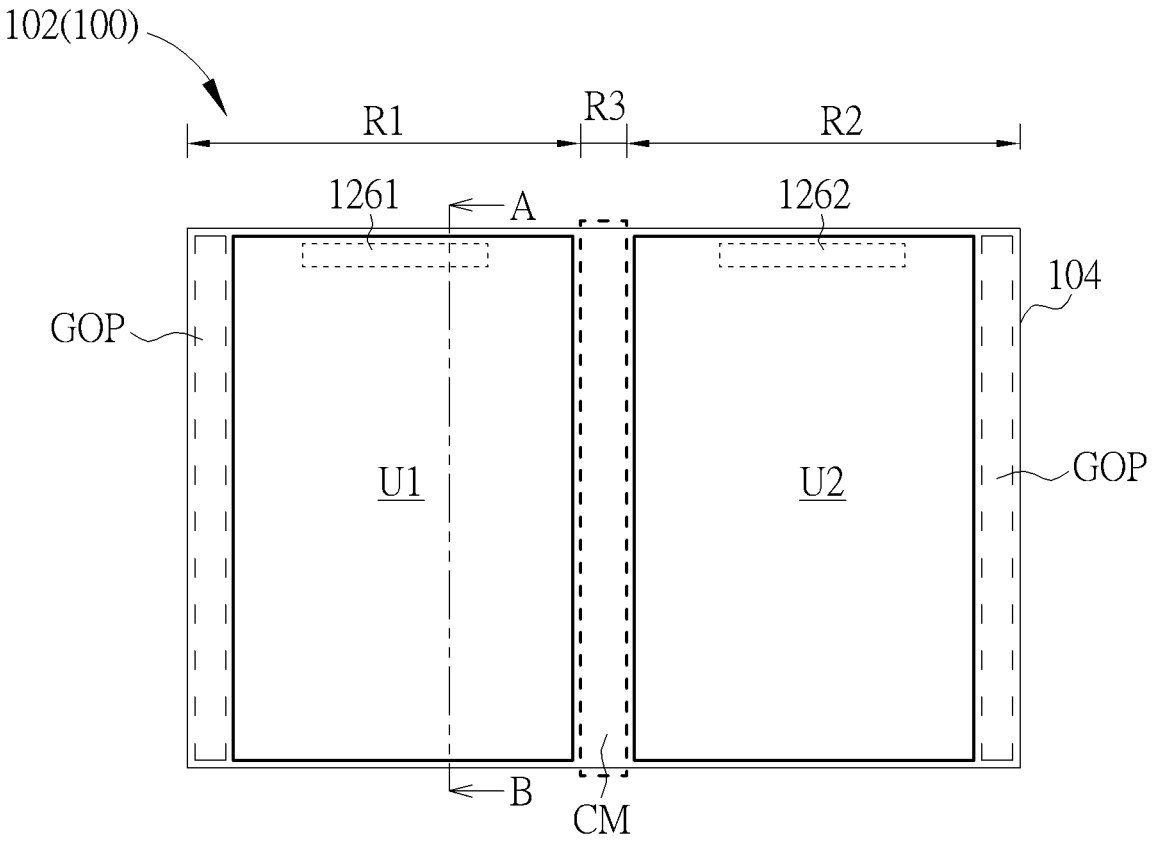
FIG. 17 is a top-view schematic diagram of a display device according to a ninth embodiment of the present disclosure.
Figure 18:
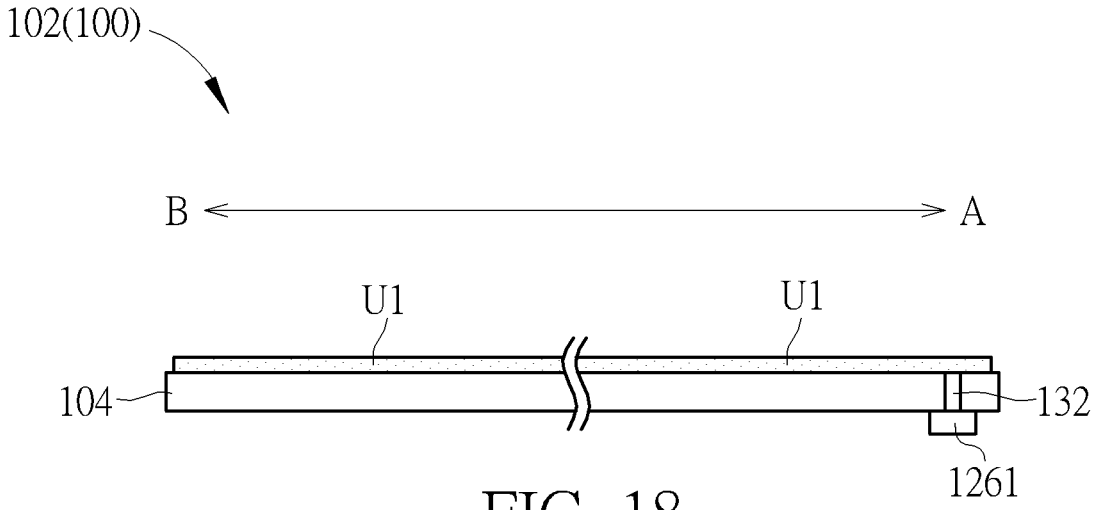
FIG. 18 is a sectional-view schematic diagram of the display device along the line A-B shown in FIG. 17.

Referring to FIG. 17 and FIG. 18, FIG. 17 is a top-view schematic diagram of a display device according to an ninth embodiment of the present disclosure, and FIG. 18 is a sectional-view schematic diagram of the display device along the line A-B shown in FIG. 17. In this embodiment, the IC chip 1261 corresponding to the first display unit U1 and the IC chip 1262 corresponding to the second display unit U2 is disposed at the back side of the display device 100, and the IC chips 1261 and 1262 are respectively electrically connected to the corresponding display unit through the through holes 132, i.e. through TGV technology. In addition, the gate driver regions GOP are disposed at the left side and the right side of the substrate 104, thus the upper border and the lower border of the display device 100 are narrowed. In addition, the border between the first display unit U1 and the second display unit U2 is also narrowed.

Figure 19:
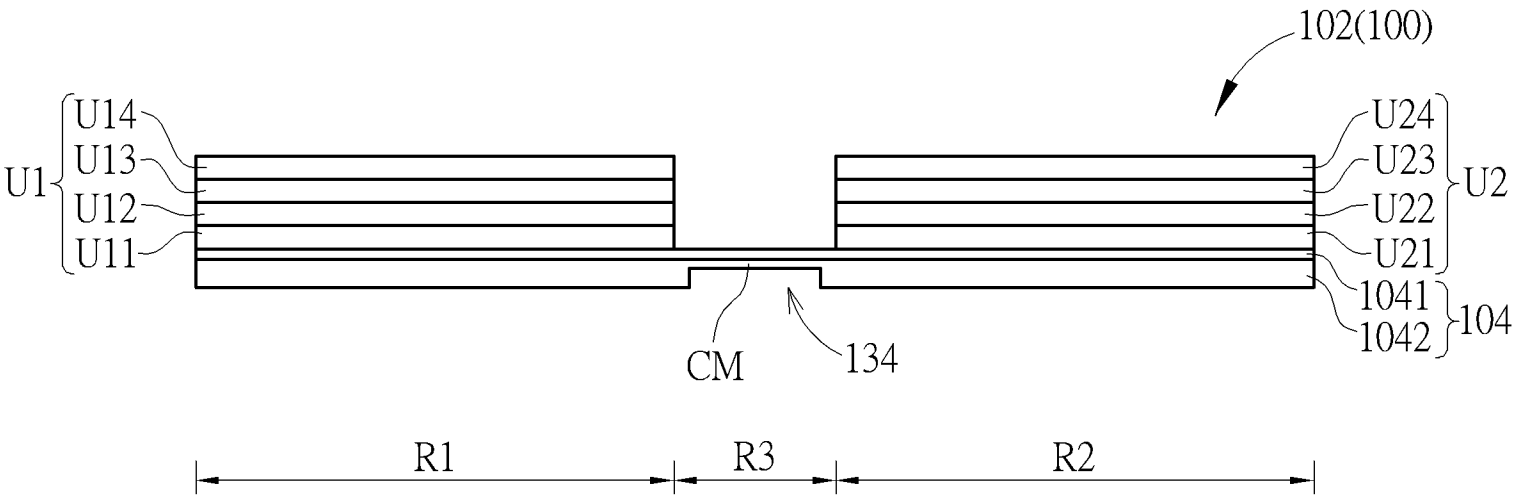
FIG. 19 is a sectional-view schematic diagram of a display device according to a tenth embodiment of the present disclosure.

Referring to FIG. 19, FIG. 19 is a sectional-view schematic diagram of a display device according to a tenth embodiment of the present disclosure. The top-view of the display device 100 of this embodiment may be similar to the first embodiment shown in FIG. 1. Compared with the sectional structure of the first embodiment shown in FIG. 2, the display device 100 of this embodiment illustrated in FIG. 19 is different in that the connecting member CM includes a recessed portion 134 disposed in the foldable region R3, at the backside of the substrate 104 opposite to the disposition side of the display units. The recessed portion 134 is disposed in the substrate 104. In other words, the foldable region R3 includes the recessed portion 134. The disposition of the recessed portion 134 can reduce the stress of the display device 100, especially when the display device 100 is in a folded state. In addition, the recessed portion 134 of this embodiment may have a smaller width than the foldable region R3, but not limited thereto.

According to some embodiments, the substrate 104 can be a single layer. Or alternatively, the substrate 104 can includes two or more layers. As shown in FIG. 19, the substrate 104 can include a flexible substrate 1041 and a supporting film 1042. The flexible substrate 1041 is disposed on the supporting film 1042, and the recessed portion 134 is disposed in the supporting film 1042. In some embodiments, the supporting film 1042 may be disposed between the flexible substrate 1041 and the supporting film 1042 for connecting the flexible substrate 1041 and the supporting film 1042.

Figure 20:
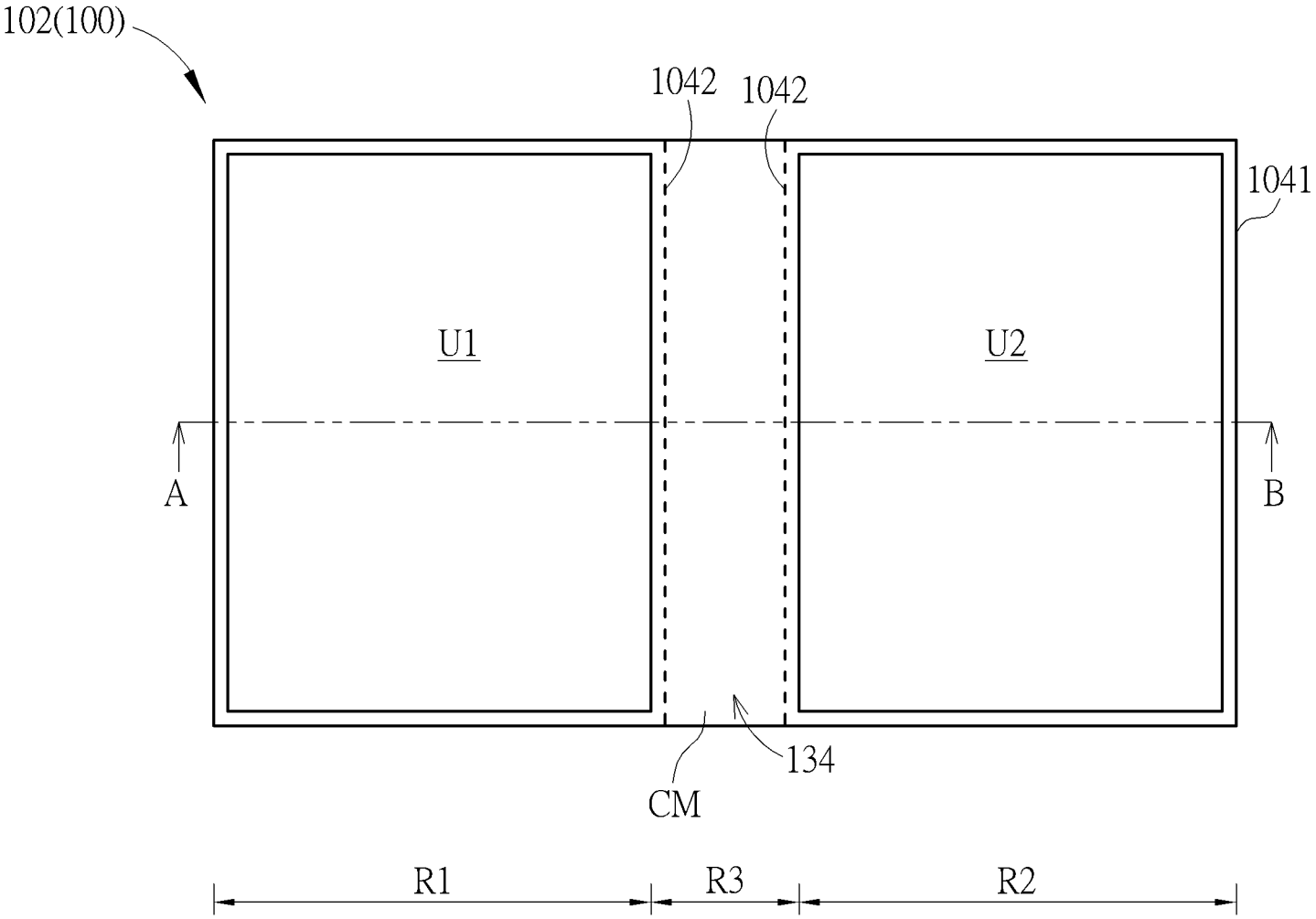
FIG. 20 is a top-view schematic diagram of a display device according to an eleventh embodiment of the present disclosure.
Figure 21:
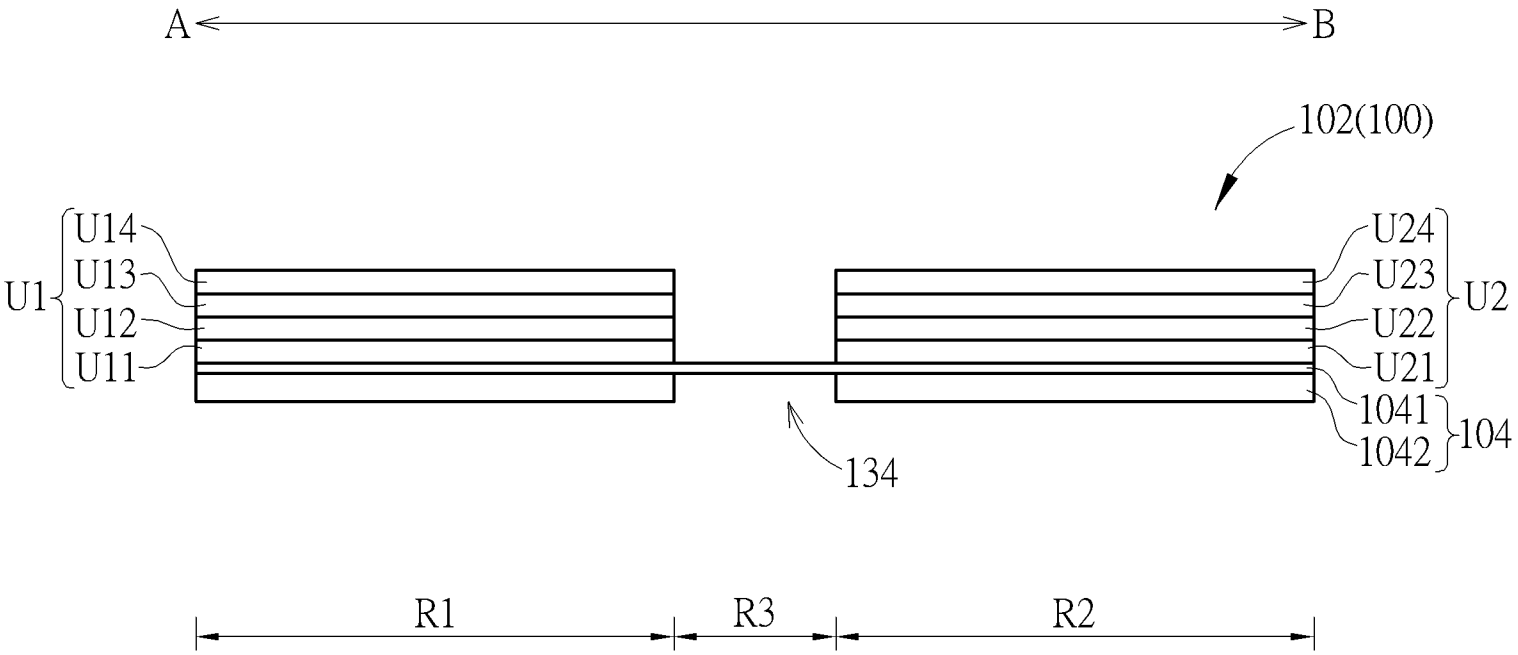
FIG. 21 is a sectional-view schematic diagram of the display device shown in FIG. 20.

Referring to FIG. 20 and FIG. 21, FIG. 20 is a top-view schematic diagram of a display device according to a eleventh embodiment of the present disclosure, and FIG. 21 is a sectional-view schematic diagram of the display device shown in FIG. 20. In this embodiment, the recessed portion 134 of the substrate 104 separates the supporting film apart, which means that the substrate 104 may include two separate supporting films 1042. Therefore, only a portion of the flexible substrate 1041 serves as the connecting member CM for connecting the first display unit U1 and the second display unit U2.

Figure 22:
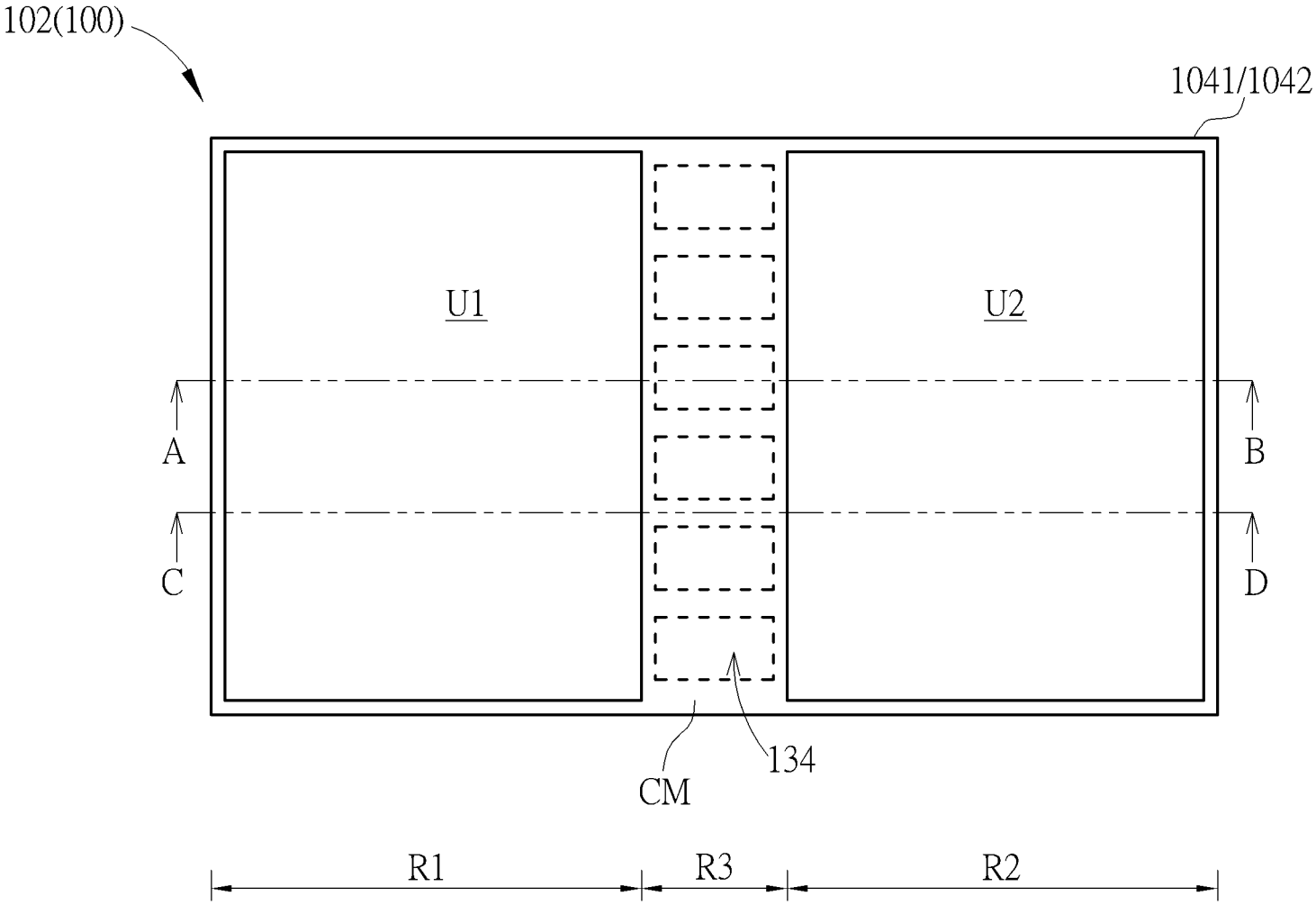
FIG. 22 is a top-view schematic diagram of a display device according to a twelfth embodiment of the present disclosure.
Figure 23:
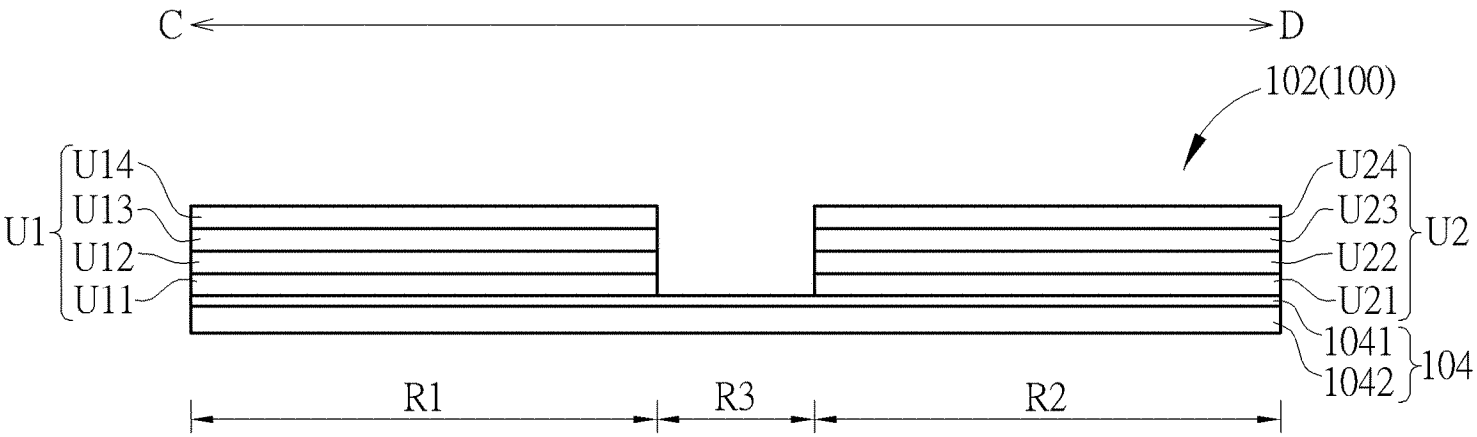
FIG. 23 is a sectional-view schematic diagram of the display device along line C-D shown in FIG. 22.
Figure 24:
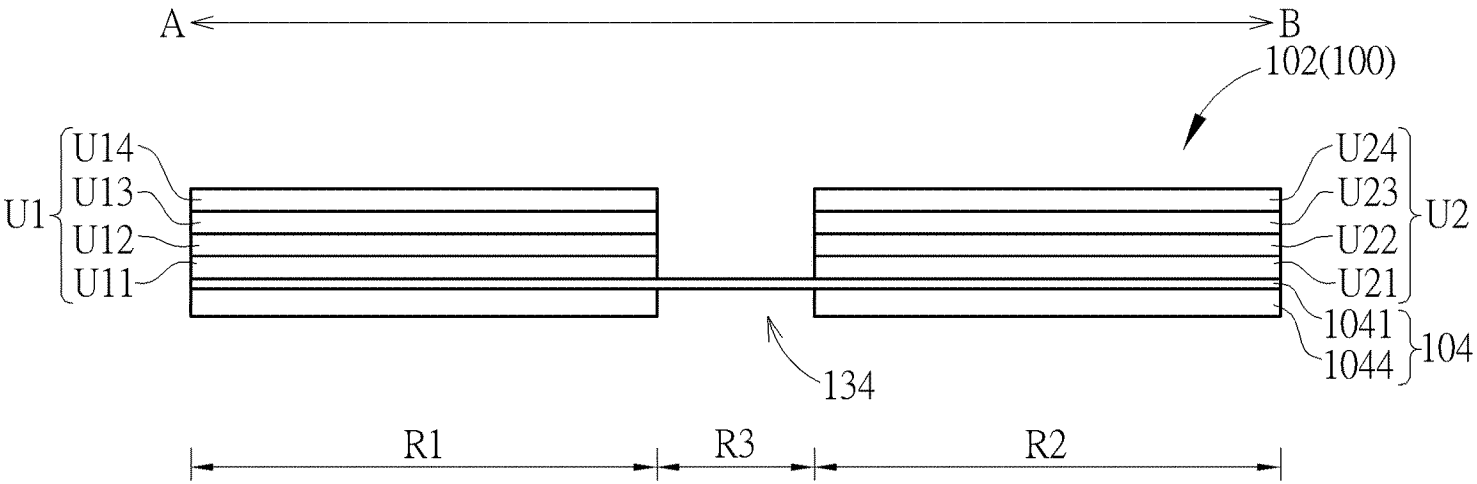
FIG. 24 is a sectional-view schematic diagram of the display device along line A-B shown in FIG. 22.

Referring to FIG. 22 to FIG. 24, FIG. 22 is a top-view schematic diagram of a display device according to a twelfth embodiment of the present disclosure, FIG. 23 is a sectional-view schematic diagram of the display device along line C-D shown in FIG. 22, and FIG. 24 is a sectional-view schematic diagram of the display device along line A-B shown in FIG. 22. In this embodiment, the connecting member CM of the display device 100 includes a plurality of recessed portions 134 spaced apart from each other. For the part of the connecting member CM without the recessed portions 134, the connecting member CM has both the flexible substrate 1041 and the supporting film 1042, as shown in FIG. 23. For the part of the connecting member CM having the recessed portions 134, the connecting member CM has only the flexible substrate 1041, as shown in FIG. 24. In other words, the supporting film 1042 has a plurality of holes corresponding to the recessed portion 134.

Figure 25:
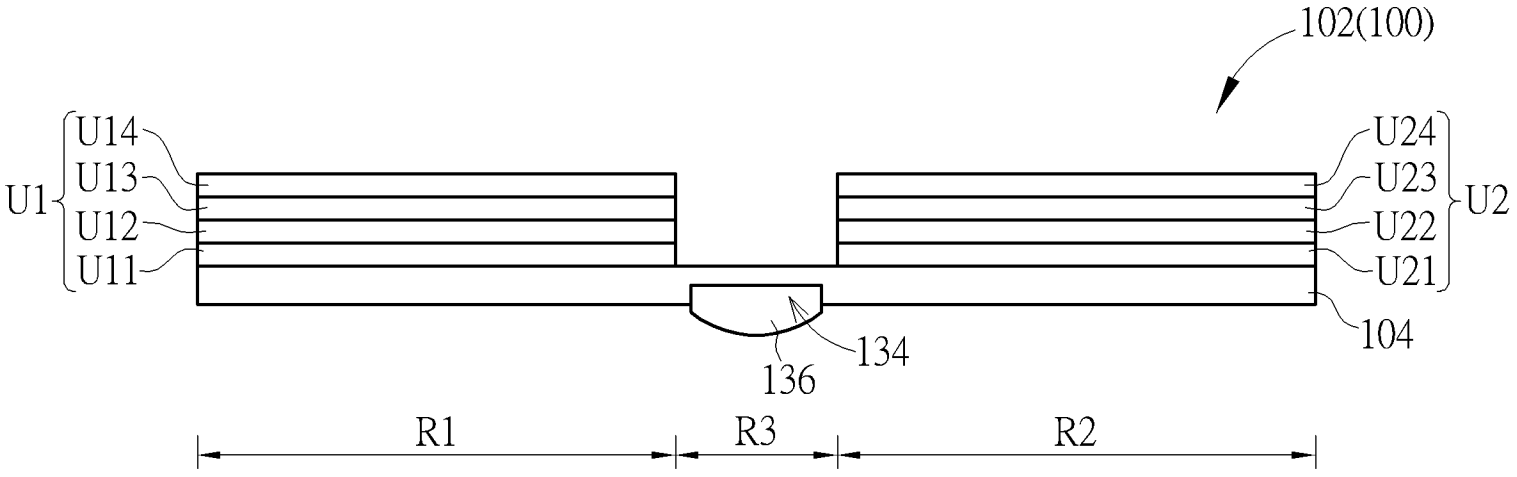
FIG. 25 is a sectional-view schematic diagram of a display device according to a thirteenth embodiment of the present disclosure.

Referring to FIG. 25, FIG. 25 is a sectional-view schematic diagram of a display device according to a thirteenth embodiment of the present disclosure. The main difference between this embodiment and the tenth embodiment shown in FIG. 19 is that a tensile glue 136 is further disposed in the recessed portion 134 of the foldable region R3 for protecting the substrate 104, in order to mitigate the deterioration of the flexibility when the display device 100 is folded many times. The tensile glue 136 may fully fill the recessed portion 134 and be slightly protrudent from the recessed portion 134 and the substrate 104, but not limited thereto. The tensile glue 136 has tensile characteristics and may be flexible and deformed according to the folding state of the display device 100, so as to protect the folded substrate 104. As mentioned above, the display device 100 can be folded outwardly or inwardly.

Figure 26:
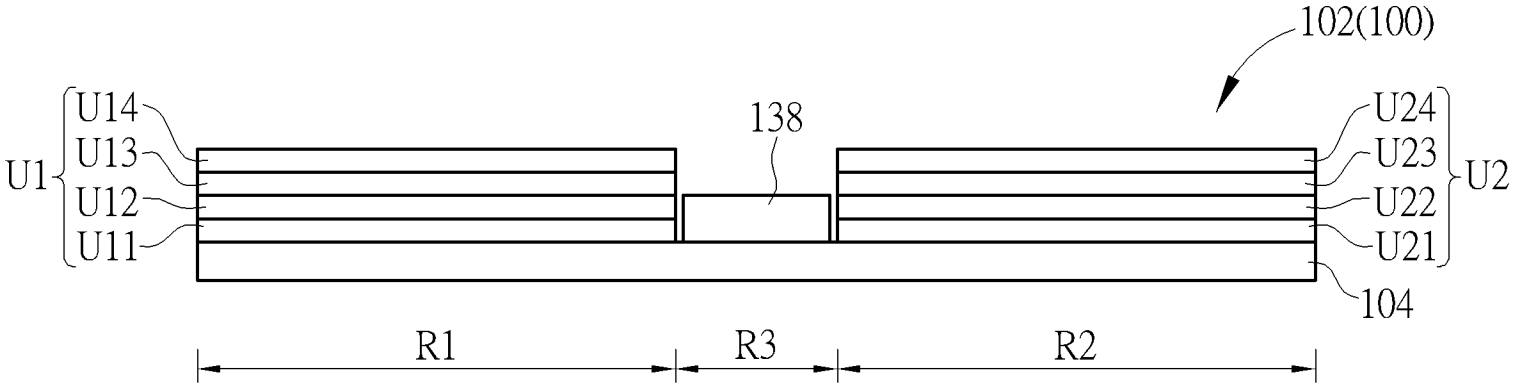
FIG. 26 is a sectional-view schematic diagram of a display device according to a fourteenth embodiment of the present disclosure.

Referring to FIG. 26, FIG. 26 is a sectional-view schematic diagram of a display device according to a fourteenth embodiment of the present disclosure. The main difference between this embodiment and the first embodiment shown in FIG. 2 is that a protecting layer 138 is disposed in the foldable region R3, at the front surface of the substrate 104, which is the same surface where the first display unit U1 and the second display unit U2 are disposed. The protecting layer 138 provides moisture resistant function to block water vapor from the environment, so as to reduce the damage risk of the substrate 104. In a variant embodiment, the substrate 104 may include a recessed portion at its backside, opposite to the disposition surface of the protecting layer 138, as mentioned in the previous embodiments.

Figure 27:
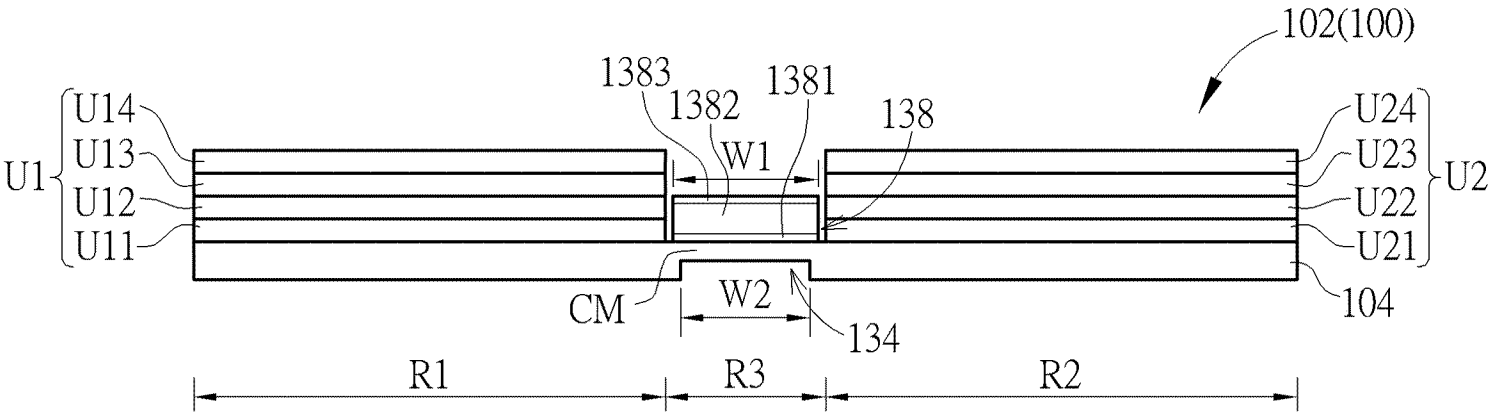
FIG. 27 is a sectional-view schematic diagram of a display device according to a fifteenth embodiment of the present disclosure.

Referring to FIG. 27, FIG. 27 is a sectional-view schematic diagram of a display device according to a fifteenth embodiment of the present disclosure. In this embodiment, the connecting member CM includes a recessed portion 134 at the backside of the display device 100 and a protecting layer 138 at the front surface of the substrate 104, wherein the width W1 of the protecting layer 138 is greater than the width W2 of the recessed portion 134. In addition, the protecting layer 138 can have a multi-layer structure. For example, the protecting layer 138 may include a first inorganic film 1381, an organic film 1382, and a second inorganic film 1383 stacked from bottom to top. In this embodiment, the thickness of the organic film 1382 is greater than the thickness of the first inorganic film 1381 and the second inorganic film 1383, but not limited thereto. According some embodiments, the protecting layer 138 can be formed as a same layer and in the same procedure as the insulating layer 117 as shown in FIG. 5.

The connecting member of the present disclosure is not limited to the substrate introduced in the previous embodiments. It may be a part of the layer forming a portion of the display units, such as a cover layer, a polarizer, an insulating layer, and so on.

Figure 28:
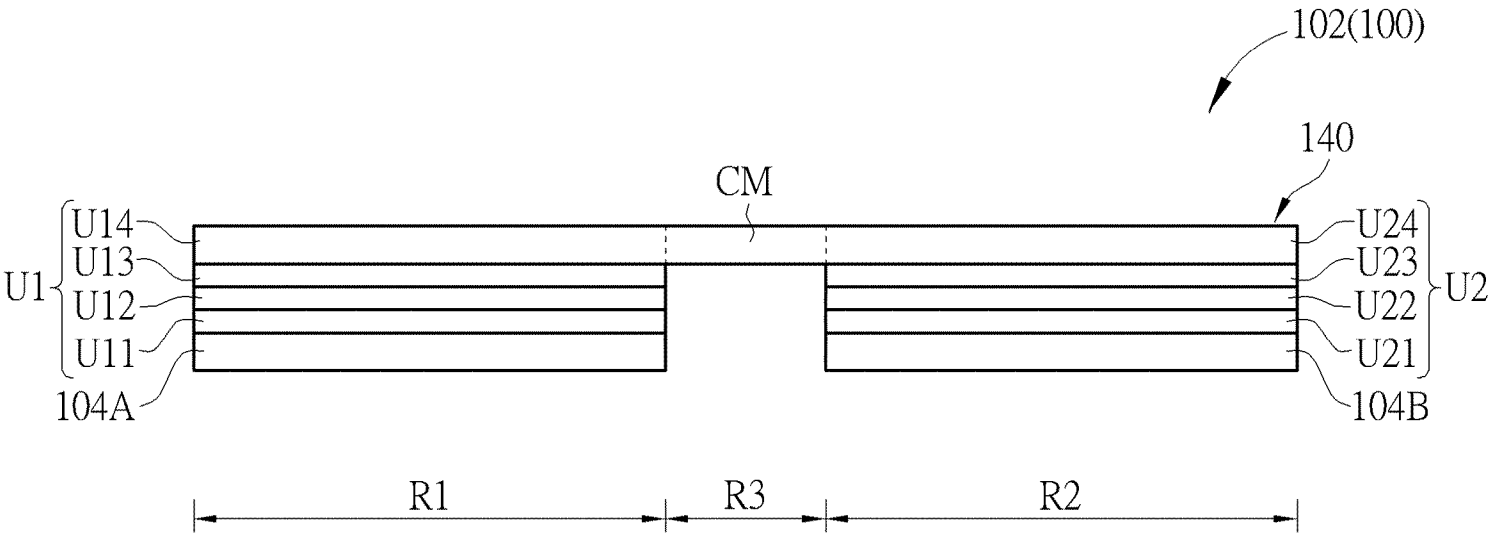
FIG. 28 is a sectional-view schematic diagram of a display device according to a sixteenth embodiment of the present disclosure.

Referring to FIG. 28, FIG. 28 is a sectional-view schematic diagram of a display device according to a sixteenth embodiment of the present disclosure. This embodiment is different from the previous embodiment in that a cover layer 140 is used for connecting the first display unit U1 and the second display unit U2, and therefore the portion of the cover layer 140 in the foldable region R3 is considered as the connecting member CM of the display device 100. The portion of the cover layer 140 in contact with and covering the touch layer U13 may be included by the first display unit U1, which is considered as the cover layer U14 of the first display unit U1. In other words, the cover layer U14 included by the first display unit U1 serves as a first connecting means, and the first display unit U1 is connected with the connecting member CM via the first connecting means, the cover layer U14. Similarly, the portion of the cover layer 140 in contact with and covering the touch layer U23 may be included by the second display unit U2, which is considered as the cover layer U24 of the second display unit U2. In other words, the cover layer U24 included by the second display unit U2 serves as a second connecting means, and the second display unit U2 is connected with the connecting member CM via the second connecting means, the cover layer U24. In this embodiment, the first connecting means, the second connecting means, and the connecting member CM are formed of the same cover layer 140. The cover layer 140 may be a thin glass substrate. In some embodiments, the cover layer 140 may be a polymeric layer (such as a PI layer) or include a polymer layer (such as a PI film), but not limited thereto. In this embodiment, the first display unit U1 and the second display unit U2 have independent substrate 104A and substrate 104B respectively.

Figure 29:
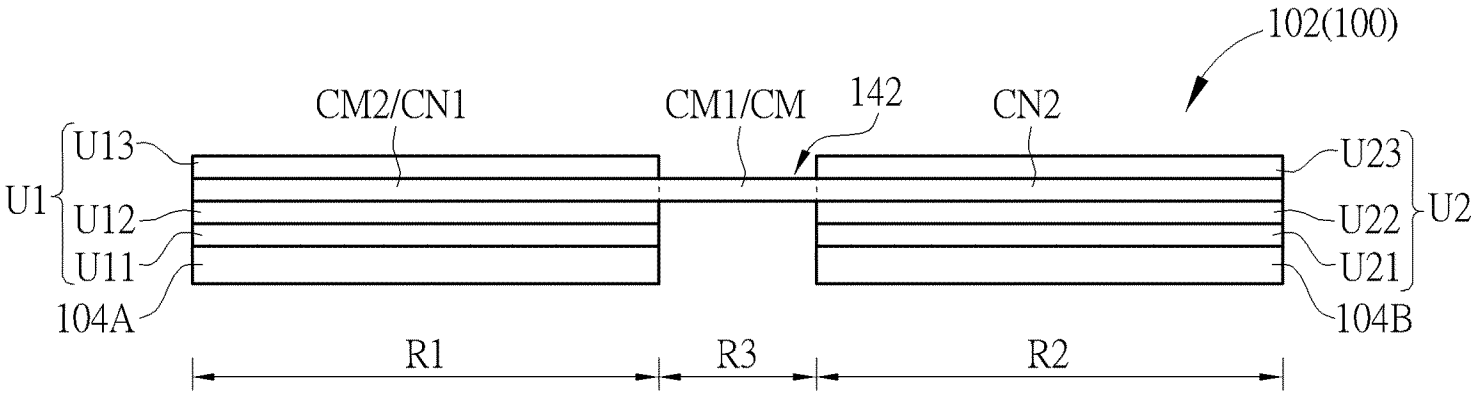
FIG. 29 is a sectional-view schematic diagram of a display device according to a seventeenth embodiment of the present disclosure.

Referring to FIG. 29, FIG. 29 is a sectional-view schematic diagram of a display device according to a seventeenth embodiment of the present disclosure. In this embodiment, the connecting member CM is formed of an insulating film 142 disposed between the touch layer U13 and the display layer U12 and between the touch layer U23 and the display layer U22. For example, the first display unit U1 and the second display unit U2 are out-cell or on-cell touch display panels, and the touch layer U13 and the touch layer U23 are attached onto or formed on the insulating film 142. The part of the insulating film 142 corresponding to the touch layer U13 may be considered as being included in the first display unit U1, serving as a first connecting means CN1. The first display unit U1 is connected with the connecting member CM via the first connecting means CN1. Similarly, the part of the insulating film 142 corresponding to the touch layer U23 may be considered as being included in the second display unit U2, serving as a second connecting means CN2. The second display unit U2 is connected with the connecting member CM via the second connecting means CN2. In another saying, the foldable region R3 of the display device 100 includes a first connecting member CM1, and at least one of the first display region R1 and the second display region R2 includes a second connecting member connecting to the first connecting member CM1. For example, the first display region R1 includes a second connecting member CM2 connected to the first connecting member CM1. The first connecting member CM1 and the second connecting member CM2 in this embodiment is formed of a same layer, which is the insulating film 142. In this embodiment, the first display unit U1 and second display unit U2 are respectively disposed on independent substrate 104A and substrate 104B. The connection and relative structure between the first connecting member CM1 and the second connecting member CM2 or between the first connecting means CN1, the second connecting means CN2 and the connecting member CM are suitable for any other afore-mentioned embodiments.

Figure 30:
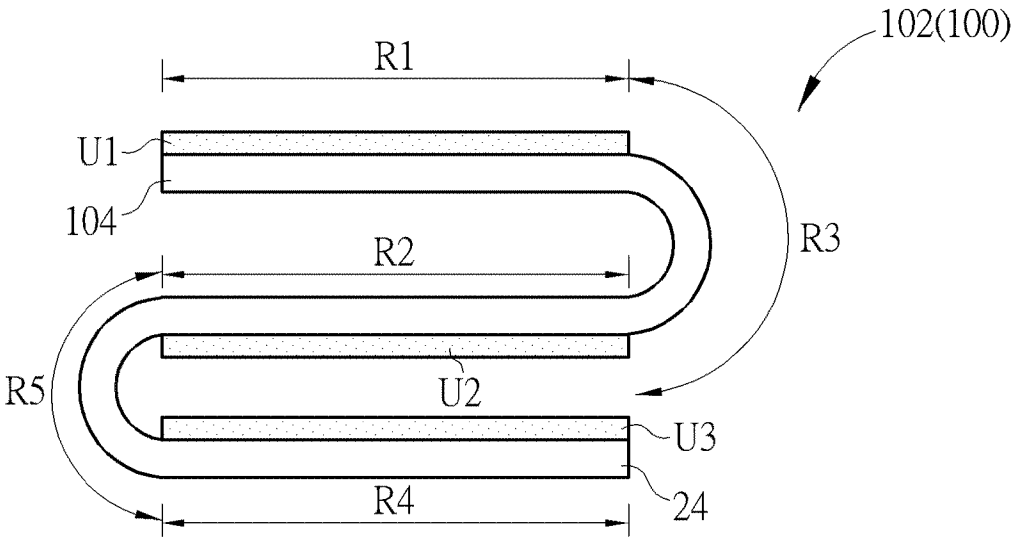
FIG. 30 is a sectional-view schematic diagram of a display device according to a further embodiment of the present disclosure.

Referring to FIG. 30, FIG. 30 is a sectional-view schematic diagram of a display device according to a further embodiment of the present disclosure. In this embodiment, the display device 100 includes a first display unit U1, a second display unit U2, and a third display unit U3 disposed in a first display region R1, a second display region R2, and a third display region R4 of the display device 100 respectively. The display device 100 further includes a foldable region R3 between the first display region R1 and the second display region R2 and a foldable region R5 between the third display region R4 and the second display region R2. The foldable regions R3 and R5 can be folded repeatedly. There is no signal transmission between the display regions through the foldable regions R3 and R5. This embodiment introduces that the present disclosure can be applied to a folded display device with more than one foldable region and more than two display units.

According to the present disclosure, the foldable display device includes a foldable region, and a connecting member is disposed in the foldable region for connecting two or more display units. According to some embodiments, the connecting member may be any part of the layer included by the display units. For example, the connecting member can be the same layer as a substrate, a polymer layer, an insulating layer, a polarizer layer, an encapsulation layer, or a cover layer. In addition, various arrangements of the control circuit and driver (such as the timing controller, the IC chip, and the driver circuit) and connecting method are described in the embodiments, and they are not intended to limit the application of the present disclosure. There is no signal transmission between the display units through the connecting member. According to some embodiments, there is no electronic element disposed in the foldable region, so as to mitigate the damages to the electronic elements. As a result, the reliable and lifetime of the foldable display device can be improved.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A foldable display device, comprising:

a display panel having a first display region, a second display region, and a foldable region adjacent between the first display region and the second display region, wherein the foldable region is capable of being repeatedly folded, wherein there is no signal transmission between the first display region and the second display region through the foldable region, and there is no driver disposed in the foldable region.

2. The foldable display device as claimed in claim 1, wherein the foldable display device includes a polymer layer disposed in the foldable region.

3. The foldable display device as claimed in claim 1, wherein the foldable region includes a first connecting member, and at least one of the first display region and the second display region includes a second connecting member connecting to the first connecting member.

4. The foldable display device as claimed in claim 3, wherein the first connecting member and the second connecting member are formed of a same layer.

5. The foldable display device as claimed in claim 1, wherein the foldable region includes a recessed portion.

6. The foldable display device as claimed in claim 1, further comprising a control unit electrically connected to the first display region and the second display region.

7. A foldable display device, comprising:

a display panel having a first display unit, a second display unit, and a first connecting member connecting the first display unit and the second display unit, wherein the first connecting member is capable of being repeatedly folded and disposed in a foldable region of the display panel, wherein there is no signal transmission between the first display unit and the second display unit through the first connecting member, and there is no driver disposed in the foldable region.

8. The foldable display device as claimed in claim 7, wherein the first connecting member includes a polymer layer.

9. The foldable display device as claimed in claim 7, wherein the first connecting member is a polymer layer.

10. The foldable display device as claimed in claim 7, wherein at least one of the first display unit and the second display unit includes a second connecting member connecting to the first connecting member.

11. The foldable display device as claimed in claim 10, wherein the first connecting member and the second connecting member are formed of a same layer.

12. The foldable display device as claimed in claim 7, wherein the first connecting member includes a recessed portion.

13. The foldable display device as claimed in claim 7, further comprising a control unit electrically connected to the first display unit and the second display unit.

* * * * *